United States Patent [19]

Tani et al.

[11] Patent Number: 4,900,656

[45] Date of Patent: Feb. 13, 1990

[54] SILVER HALIDE COLOR PHOTOGRAPHIC MATERIAL

[75] Inventors: Tadaaki Tani; Mikio Ihama; Masaki Okazaki, all of Kanagawa, Japan

[73] Assignee: Fuji Photo Film Co., Ltd., Kanagawa, Japan

[21] Appl. No.: 249,197

[22] Filed: Sep. 26, 1988

Related U.S. Application Data

[63] Continuation of Ser. No. 899,140, Aug. 22, 1986, abandoned.

[30] Foreign Application Priority Data

Aug. 22, 1985 [JP] Japan ..... 60-184485

[51] Int. Cl.[4] ..... G03C 1/14; G03C 7/34

[52] U.S. Cl. ..... 430/550; 430/552; 430/553; 430/569

[58] Field of Search ..... 430/550, 552, 553, 569

[56] References Cited

U.S. PATENT DOCUMENTS

| | | | |
|---|---|---|---|
| 4,225,666 | 9/1980 | Locker et al. | 430/569 |
| 4,513,081 | 4/1985 | Okazaki et al. | 430/552 |
| 4,683,193 | 7/1987 | Ihama et al. | 430/570 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A silver halide color photographic material and a process for preparing the photographic material are disclosed, comprising a support and at least one silver halide emulsion layer on the support, wherein the emulsion layer contains a silver halide emulsion which has been spectrally sensitized by adding a spectrally sensitizing dye prior to the completion of formation of silver halide particles, and at least one cyan coupler represented by formula (I)

(I)

wherein $R_{11}$ and $R_{12}$ each represents an alkyl group, an aryl group, a heterocyclic group, an alkyloxy group, an aryloxy group, a heterocyclic oxy group, an alkylamino group, an arylamino group, or a heterocyclic amino group, $R_{13}$ represents a hydrogen atom, a halogen atom, an alkyl group, an aryl group, an alkoxyl group, an aryloxy group, an acyloxy group, or an acylamino group, X is a group capable of being released upon the oxidative coupling reaction with a developing agent, or $R_{12}$ and $R_{13}$ together form a 5- or 6-membered ring.

19 Claims, No Drawings

SILVER HALIDE COLOR PHOTOGRAPHIC MATERIAL

This is a continuation of application Ser. No. 06/899,140 filed Aug. 22, 1986 now abandoned.

BACKGROUND OF THE INVENTION

The present invention relates to a silver halide color photographic material, and more particularly to a silver halide color photographic material which is excellent in the dark heat fading resistance properties of a cyan color image formed therein, and is also excellent in storage stability and preparation stability.

A silver halide color photographic material is a multilayer construction material comprising a plurality of light-sensitive layers coated on a support, said light-sensitive layers typically comprising at least 3 types of silver halide emulsion layers which are selectively sensitized so as to exhibit sensitivity to blue light, green light, and red light. In a so-called color printing paper (hereinafter referred to as a "color paper"), for example, a red-sensitive emulsion layer, a green-sensitive emulsion layer, and a blue-sensitive emulsion layer are usually coated, in the order listed, on the side to be exposed to light. In addition, interlayers used to prevent color mixing and to absorb ultraviolet rays, a protective layer, and so forth are provided in addition to the above light-sensitive layers.

In a so-called color positive film, in general, a green-sensitive emulsion layer, a red-sensitive emulsion layer, and a blue-sensitive emulsion layer are coated in the order listed from the remote side of a support, i.e., a side to be exposed to light. On the other hand, in a color negative film, the layer arrangement may be more varied. In general, a blue-sensitive emulsion layer, a green-sensitive emulsion layer, and a red-sensitive emulsion layer are coated in the order listed on the side of the support to be exposed. In some of light-sensitive materials having two or more emulsion layers having the same color sensitivity but having different sensitivities, an emulsion layer having a different color sensitivity from that of the above emulsion layers is provided between the emulsion layers. In addition, a bleachable yellow filter layer, an interlayer, a protective layer, and so forth are provided therebetween.

To form a color photographic image, three photographic couplers of yellow, magenta, and cyan are incorporated in light-sensitive materials and an exposed light-sensitive material is subjected to a color developing treatment using a so-called color developing agent. An oxidization product of an aromatic primary amine undergoes a coupling reaction with a coupler to therby form a colored dye. At this time, it is desirable for the color forming properties to be such that the coupling speed is as high as possible and a high color density can be obtained in a limited developing time. It is further desired for the color dyes to be cyan, magenta, and yellow dyes which are reduced in side-absorption and form sharp images, and to be capable of providing a color photographic image having good color reproductivity.

For the formed color photographic image, it is required to have good storage stability under varied conditions. These storage conditions include dark storage conditions while subjected to the influence of humidity and heat, and conditions or irradiation with light such as sun light, room lamp, and the like. Not only discoloration or fading of the color image, but also discoloration to yellow of the white background have posed serious problems.

The function of a coupler as a color imageforming agent is important to satisfy the above requirements for a color light-sensitive material. Improvements of the coupler by changing the structure thereof have heretofore been made. In particular, color images formed from conventional cyan couplers are poor in dark heat fading resistance properties, and are unsatisfactory from viewpoint of storage. On the other hand, the cyan couplers represented by formula (I) as described hereinafter are excellent in dark heat fading resistance properties, but are easily reduced in sensitivity. Particularly when the coated emulsion is allowed to stand for a long time during preparation of the light-sensitive material, or when the coated light-sensitive material is stored for a long time, the above tendency becomes significant, and becomes a serious hindrance in practical use.

SUMMARY OF THE INVENTION

The present invention is intended to provide a light-sensitive material satisfying the above characteristics which are very desirable for a color light-sensitive material.

One object of the present invention is to provide a color light-sensitive material which is excellent in the dark heat fading resistance properties of a cyan image formed therewith.

Another object of the present invention is to provide a color light-sensitive material which is less subject to a sensitivity reduction due to standing of a coating emulsion in the preparation of the light-sensitive material, the storage of the coated light-sensitive material for a long time, and so forth.

Other objects of the present invention will become more apparent from the following explanation.

The present invention relates to a silver halide color photographic material comprising a support and at least one silver halide emulsion layer on the support, wherein the emulsion layer contains a silver halide emulsion which has been spectrally sensitized by adding a spectrally sensitizing dye prior to the completion of formation of silver halide particles, and at lest one cyan coupler represented by formula (I)

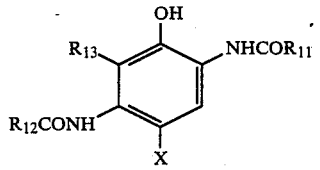

(I)

wherein $R_{11}$ and $R_{12}$ each represents an alkyl group, an aryl group, a heterocyclic group, an alkyloxy group, an aryloxy group, a heterocyclic oxy group, an alkylamino group, an arylamino group, or a heterocyclic amino group; $R_{13}$ represents a hydrogen atom, a halogen atom, an alkyl group, an aryl group, an alkoxyl group, an aryloxy group, an acyloxy group, or an acylamino group; X is a group capable of being released upon the oxidative coupling reaction with a developing agent; or $R_{12}$ and $R_{13}$ together form a 5- or 6-membered ring.

DETAILED DESCRIPTION OF THE INVENTION

The symbols of formula (I), i.e., $R_{11}$, $R_{12}$, $R_{13}$, and X, are hereinafter be explained in detail.

$R_{11}$ and $R_{12}$ each preferably has up to 32 carbon atoms and represents a chain-like or cyclic alkyl group (e.g., a methyl group, a butyl group, a cyclohexyl group, and a dodecyl group), an aryl group (e.g., a phenyl group and a naphthyl group), a heterocyclic group (e.g., a 2-pyridyl group, a 2-furyl group, and a 2-benzothiazoyl group), an alkyloxy group (e.g., a methoxy group and a dodecyloxy group), an aryloxy group (e.g., a phenoxy group and a naphthyloxy group), a heterocyclic oxy group (e.g., a 4-pyridyloxy group and a 8-quinolyloxy group), an alkylamino group (e.g., a butylamino group, a dimethylamino group, and a dodecylamino group), an arylamino group (e.g., an anilino group, a naphthylamino group, and an N-methylanilino group), or a heterocyclic amino group (e.g., a 2-pyridyl group, an imidazoyl group, a pyrazoyl group, a thiazolyl group, and a benzothiazolyl group). These groups may be substituted with groups such as an alkyl group, an aryl group, a heterocyclic group, an alkoxyl group (e.g., a methoxy group and a 2-methoxyethoxy group), an aryloxy group (e.g., a phenoxy group, a 2,4-di-tertamylphenoxy group and a 2-chlorophenoxy group), a carboxyl group, a carbonyl group (e.g., an acetyl group and a benzoyl group), an ester group (e.g., a methoxycarbonyl group, a phenoxycarbonyl group, an acetoxy group, a benzoyloxy group, a butoxysulfonyl group, and a toluenesulfonyloxy group), an amido group (e.g., an acetylamino group, an ethylcarbamoyl group, a dimethylcarbamoyl group, a methanesulfonamido group, and a butylsulfamoyl group), a sulfamido group (e.g., a dipropylsulfamoylamino group), an imido group (e.g., a succinimido group and a hydantoinyl group), a ureido group (e.g., a phenylureido group, and a dimethylureido group), a sulfonyl group (e.g., a methanesulfonyl group), a phosphoric acid amido group (e.g., a diethylphosphoric acid monoamido group and a tetramethylphosphoric acid triamido group), a hydroxyl group, a cyano group, a nitro group, a halogen atom, and a thio group (e.g., an ethylthio group and a phenylthio group).

$R_{13}$ represents a hydrogen atom, a halogen atom (e.g., a fluorine atom, a chlorine atom, and a bromine atom), an alkyl group having up to 20 carbon atoms (e.g., a methyl group, a butyl group, and a dodecyl group), an aryl group (e.g., a phenyl group), an alkoxyl group (e.g., a methoxy group and a butoxy group), an aryloxy group (e.g., a phenoxy group), an acyloxy group (e.g., an acetoxy group and a benzoyloxy group) or an acylamino group (e.g., an acetylamino group and a benzoylamino group). These groups may be substituted with the groups described as substituents for $R_{11}$ and $R_{12}$.

Alternatively, $R_{12}$ and $R_{13}$ together can form a 5- or 6-membered ring.

X represents a hydrogen atom or a halogen atom (e.g., a fluorine atom, a chlorine atom, and a bromine atom). As releasing groups represented by X, an alkoxyl group (e.g., an ethoxy group, a dodecyloxy group, a methoxyethylcarbamoyl group, a carboxymethoxy group, and a methylsulfonylethoxy group), an aryloxy group (e.g., a phenoxy group, a naphthyloxy group, and a 4-carboxyphenoxy group), an acyloxy group (e.g., an acetoxy group, a tetradecanoyloxy group, and a benzoyloxy group), a sulfonyloxy group (e.g., a methanesulfonyloxy group and a toluenesulfonyloxy group), an amido group (e.g., a dichloroacetylamino group, a heptafluorobutyrylamino group, a methanesulfonylamino group, and a toluenesulfonylamino group), an alkoxycarbonyloxy group (e.g., an ethoxycarbonyloxy group and a benzyloxycarbonyl group), an aryloxycarbonyl group (e.g., a phenoxycarbonyloxy group), a thio group (e.g., a phenylthio group and a tetrazolylthio group), an imido group (e.g., a succinimido group and a hydantoinyl group), an azo group (e.g., a phenylazo group) and the like can be given. These groups may contain a known photographically useful group or groups.

Preferred examples of the groups represented by $R_{11}$ include an alkyl group, an aryl group, an arylamino group, and a heterocyclic amino group, all of which may be substituted. Particularly preferred are a substituted or unsubstituted phenyl group, a heterocyclic amino group, and a substituted arylamino group. These groups may be substituted with the groups described as substituents for $R_{11}$ and $R_{12}$.

Preferred examples of the groups represented by $R_{12}$ include an alkyl group, an aryl group, an alkyloxy group, an alkylamino group, an arylamino group, and a heterocyclic amino group, all of which may be substituted. Particularly preferred are a substituted alkyl group or a substituted aryl group. These groups may be substituted with the groups described as substituents for $R_{11}$ and $R_{12}$.

Preferred examples of the groups represented by $R_{13}$ include a hydrogen atom, an alkyl group, an alkoxyl group, and an acylamino group. These groups may be substituted with the groups described as substituents for $R_{11}$ and $R_{12}$. $R_{13}$ combine together with $R_{12}$ to form a ring. Particularly preferred is a hydrogen atom or a ring resulting from the combination of $R_{12}$ and $R_{13}$.

Preferred examples of the groups represented by X include a hydrogen atom, a halogen atom (of which a fluorine atom and a chlorine atom are particularly preferred), an alkoxyl group, an aryloxy group, an acyloxy group, a sulfonyloxy group, a sulfonamido group, an alkoxycarbonyl group, and a thio group. Particularly preferred are a hydrogen atom, a halogen atom (of which a fluorine atom and a chlorine atom are particularly preferred), an alkoxyl group, or an aryloxy group.

Typical examples of the couplers represented by formula (I) are shown below.

I-1
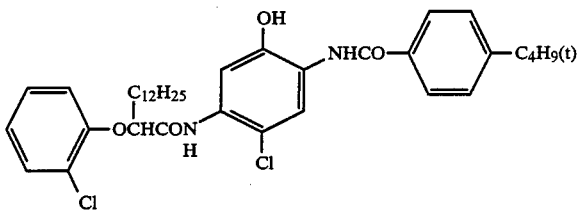
I-2
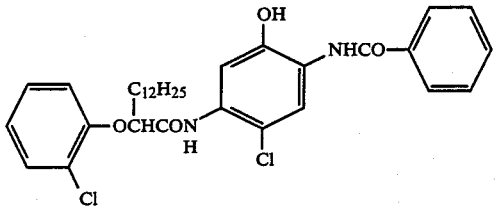
I-3
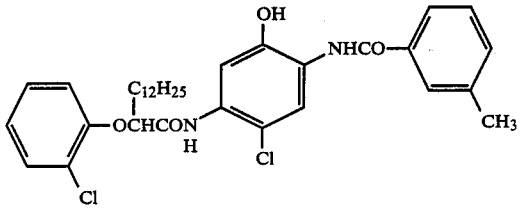
I-4
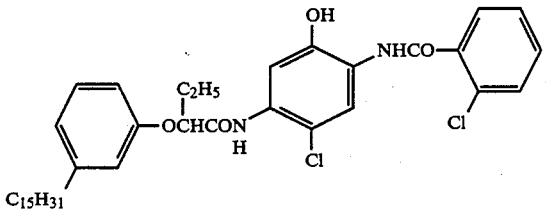
I-5
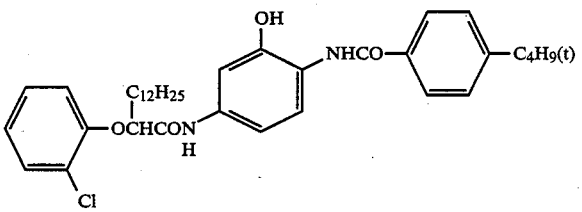
I-6
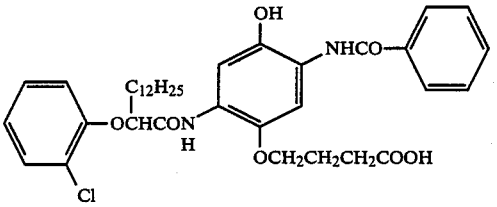
I-7
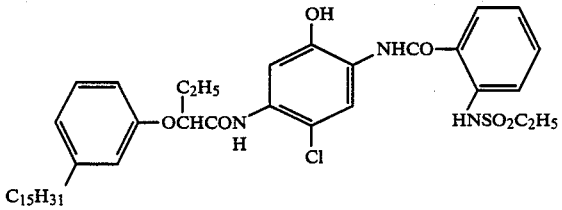

-continued
I-8
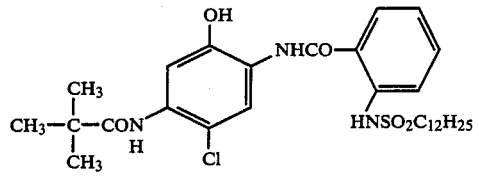
I-9
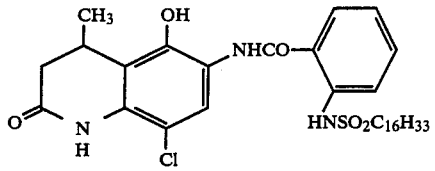
I-10
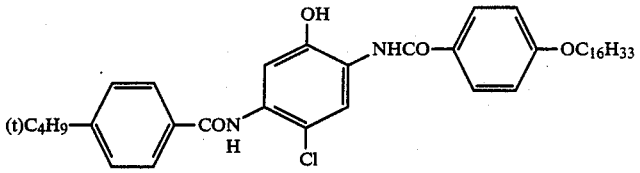
I-11
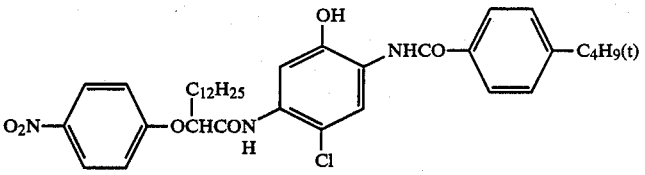
I-12
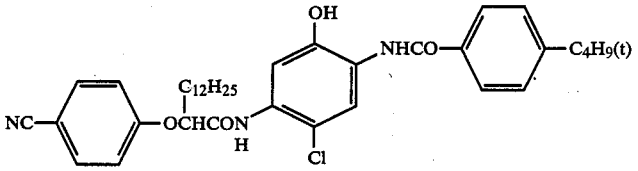
I-13
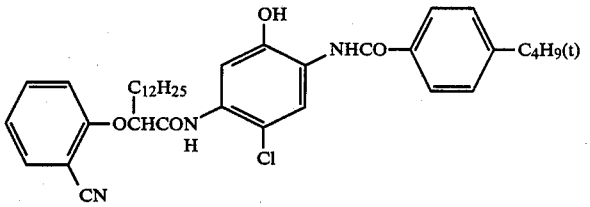
I-14
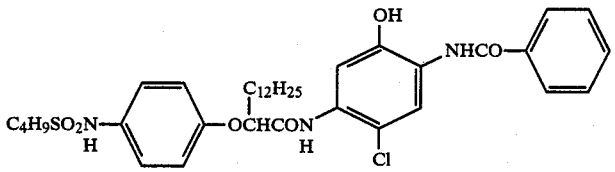
I-15
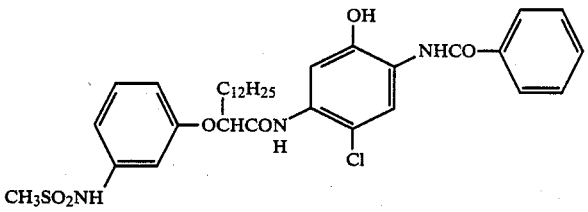

-continued
I-16
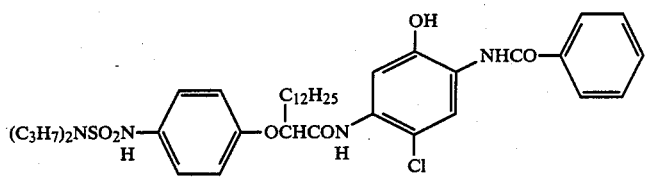
I-17
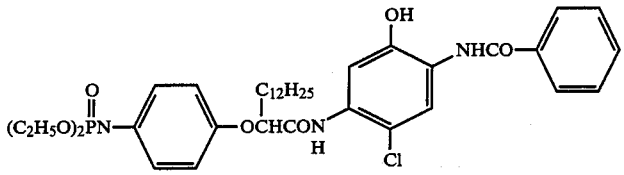
I-18
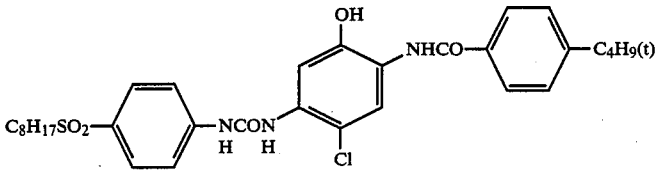
I-19
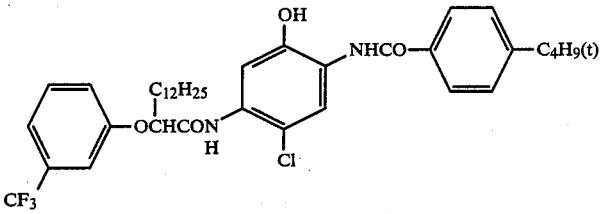
I-20
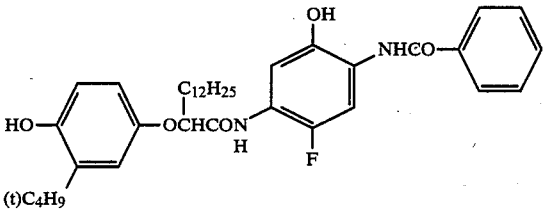
I-21
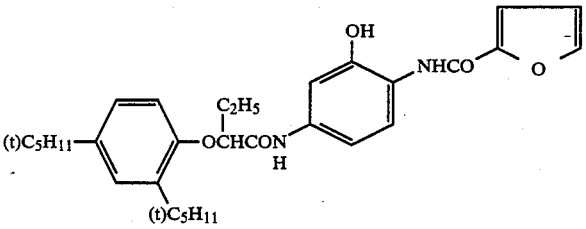
I-22
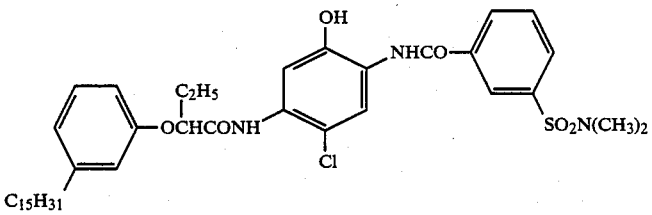

-continued
I-23
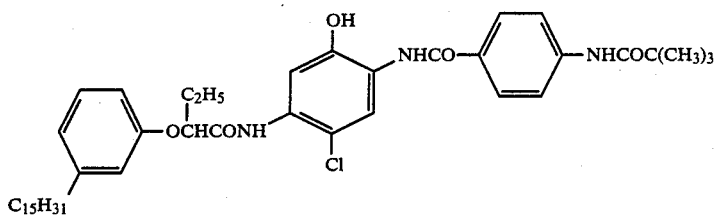
I-24
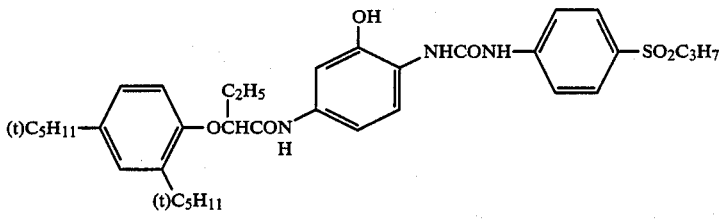
I-25
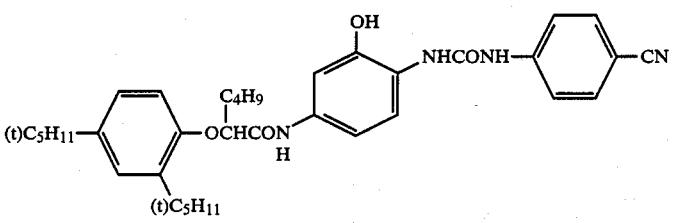
I-26
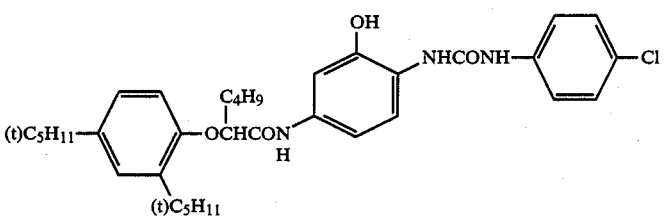
I-27
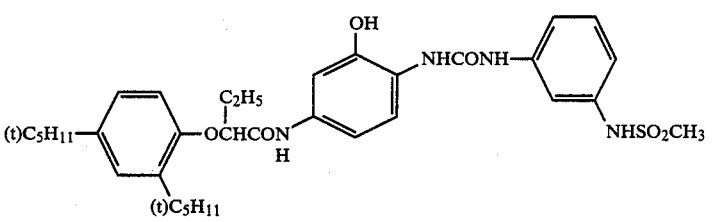
I-28
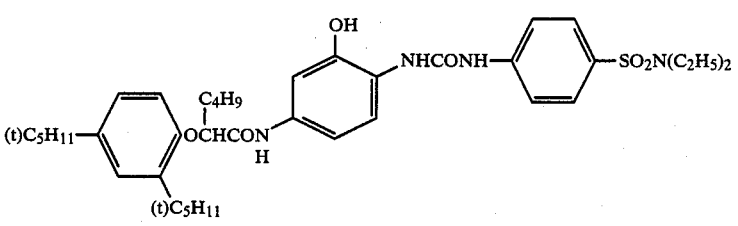
I-29
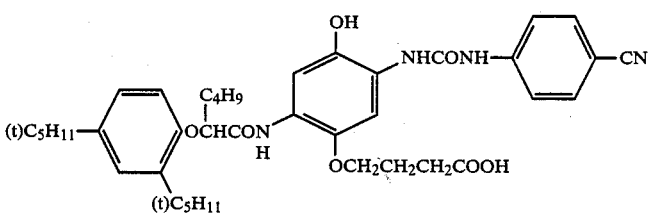

-continued
I-30
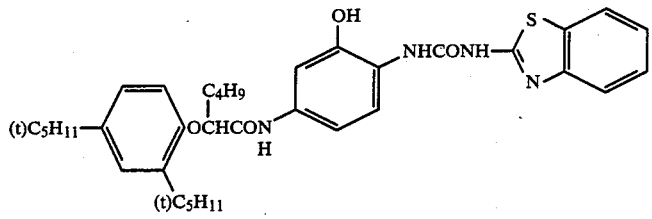
I-31
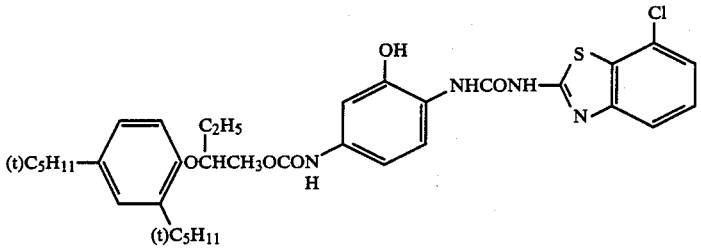
I-32
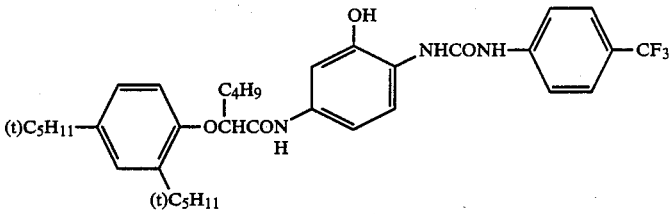
I-33
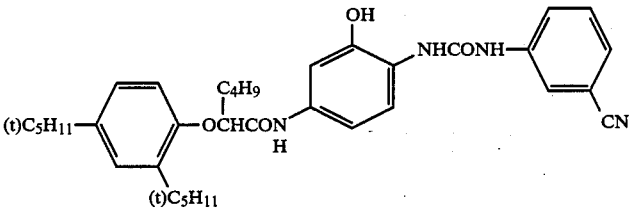
I-34
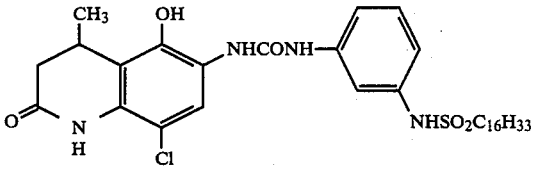
I-35
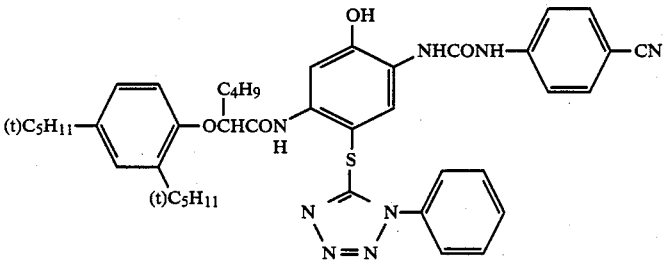

-continued
I-36
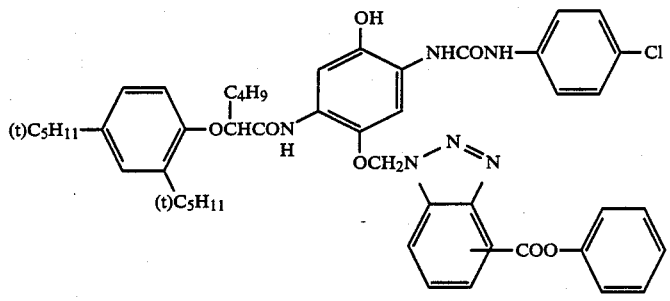
I-37
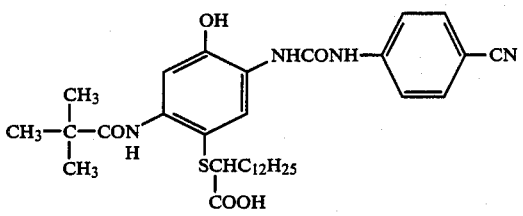
I-38
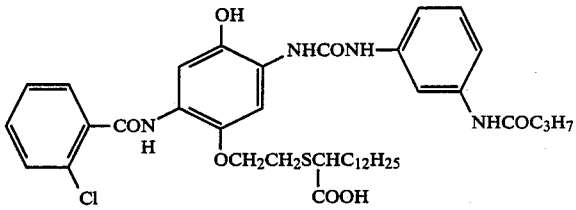
I-39
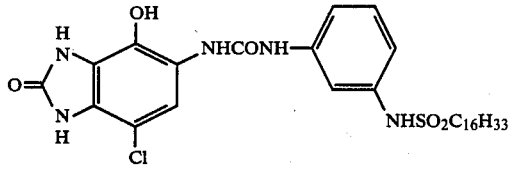
I-40
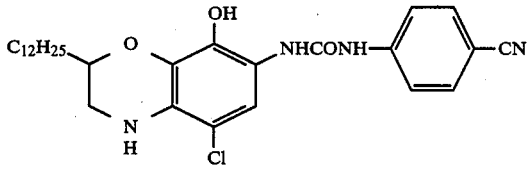
I-41
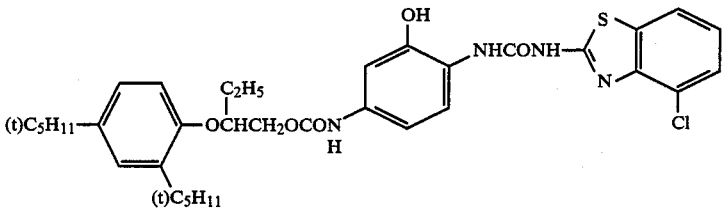
I-42
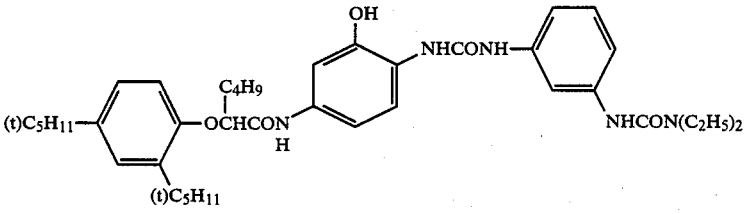
The cyan couplers of formula (I) which are used according to the present invention can be prepared by known methods according to the following synthesis route.

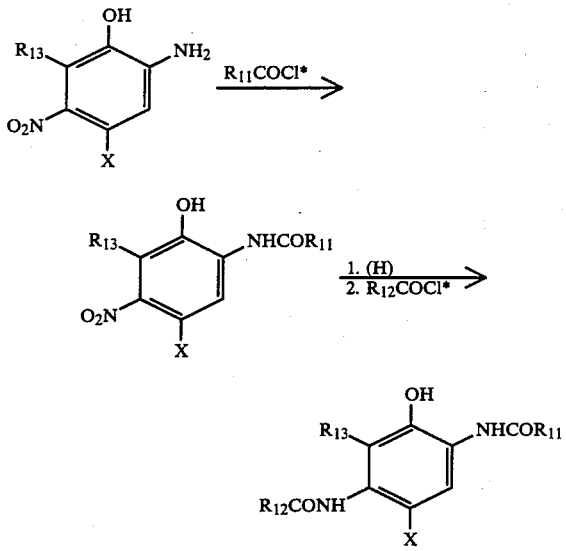

In the above formulae, $R_{11}$ to $R_{13}$, and X are as defined above. When $R_{11}$ and $R_{12}$ are amino groups, the corresponding isocyanates and phenylurethanes can be used.

Typical methods of preparation are set forth below although the present invention is not limited thereto. The other compounds can also be prepared in the same manner.

PREPARATION EXAMPLE 1

Synthesis of Coupler (I-1):

396 g of 2-amino-4-chloro-5-nitrophenol was suspended in 2.5 liters of acetonitrile, and 418 g of 4-tert-butylbenzoyl chloride was added thereto over 30 minutes while refluxing by heating. The mixture was further refluxed by heating for 1 hour, and then cooled. Crystals precipitated were collected by filtration, washed with acetonitrile and then dried to obtain 580 g of crystals (m.p., 242°–247° C.). These crystals were mixed with 466 g of powdered iron, 350 ml of water, 2 liters of isopropanol, and 30 ml of hydrochloric acid, and refluxed by heating for 1 hour.

The powdered iron was separated by filtration. Then crystals precipitated were collected by filtration and dried to obtain 480 g of 5-amino-2-(4-tert-butylbenzoylamino)-4-chlorophenol (m.p., 164°–165° C.).

95.7 g of 5-amino-2-(4-tert-butylbenzoylamino)-4-chlorophenol was added to 700 ml of acetonitrile, and 4.5 g of 2-(2-chlorophenoxy)tetradecanoyl chloride was added thereto over 1 hour while refluxing by heating. The mixture was further refluxed by heating for 2 hours. Then 1 liter of ethyl acetate was added, and washing with water, was conducted. The solvent was distilled away under reduced pressure, and crystallization was conducted using 200 ml of ethyl acetate and 300 ml of acetonitrile. In addition, recrystallization was conducted to obtain Coupler (I-1) having a melting point of 111°–113° C.

Elemental Analysis:

| | C | H | N |
|---|---|---|---|
| Found | 67.62% | 7.31% | 4.35% |
| Calculated | 67.77% | 7.38% | 4.27% |

PREPARATION EXAMPLE 2

Synthesis of Coupler (I-24):

37 g of p-propylsulfonylaniline was added to 18 ml of pyridine and 90 ml of acetonitrile, and 30.6 g of phenyl chloroformate was added thereto while cooling with ice. The resulting mixture was stirred for 2 hours and then poured into ice water containing 7 ml of hydrochloric acid. Crystals precipitated were collected by filtration, washed with water-containing methanol and then dried to obtain 58.2 g of white crystals (m.p., 171.5° C.). These crystals were suspended in 190 ml of acetonitrile along with 30.3 g of 2-amino-5-nitrophenol and then 2.3 ml of triethylamine was added. Then the resulting mixture was refluxed by heating for 6 hours. After cooling, the mixture was neutralized with hydrochloric acid. Crystals precipitated were collected by filtration and washed well with acetonitrile. 58.6 g of yellow crystals was obtained after drying.

27 g of the above crystals were added to 14 g of reduced silver, 1.2 g of ammonium chloride, 1.2 ml of acetic acid, 90 ml of isopropanol, and 15 ml of water and refluxed by heating for 2 hours. After cooling, 5.7 g of caustic soda was dissolved in water and added, and then the powdered iron was separated by filtration. Upon neutralization with acetic acid, crystals were precipitated. These crystals were dried well to obtain 22.8 g of light-red crystals.

13.6 g of the above crystals were mixed with 36 ml of acetonitrile and 4 ml of dimethylacetamide and refluxed by heating, and then 13.5 g of 2-(2,4-di-tertamylphenoxy)butanoyl chloride was added thereto. The mixture was further refluxed by heating for 1 hour, and then 70 ml of ethyl acetate was added, and washing with water was conducted. The solvent was distilled away under reduced pressure. Recrystallization using acetonitrile was conducted twice to obtain 19.8 g of the desired Coupler (I-24) having a melting point of 130°–133° C.

Elemental Analysis:

| | C | H | N |
|---|---|---|---|
| Found | 66.31% | 7.56% | 6.30% |
| Calculated | 66.33% | 7.58% | 6.45% |

The amount of the coupler according to the present invention contained in the emulsion is preferably from $1\times10^{-3}$ to $7\times10^{-1}$ mol, and more preferably from $1\times10^{-2}$ to $5\times10^{-1}$ mol, per mol of silver in the silver halide emulsion.

The sensitizing dye can be added at any desired point prior to the completion of formation of silver halide particles. This point of addition can be determined depending on the type of sensitizing dye and the type of emulsion. The total amount of the sensitizing dye added can be added to the reaction solution concurrently with the start of formation of the particles or prior to the start of formation of the particles, or can also be added at any desired point during the formation of particles. In the latter case, the sensitizing dye can be added at a point when preferably at least 85%, more preferably at least 90%, and most preferably at least 95% of the total weight of the emulsion particles is formed.

The sensitizing dye can be added in several portions. In this case, for example, the sensitizing dye divided into several portions can be added at suitable intervals at the start of formation of particles and during the course of formation of particles. Furthermore, the sensitizing dye can be added continuously before the formation of particles is completed (the sensitizing dye may be added alone or in combination with a silver nitrate solution, a halogen solution, and so forth), and the addition of the sensitizing dye can be started concurrently with the start of formation of particles or prior to the start of formation of particles, or can also be started after the start of formation of particles. In an emulsion preparation method to grow seed crystals, the sensitizing dye can be added continuously or intermittently during the course of growth.

The sensitizing dye which is used in the present invention can be dispersed directly in the emulsion. It is possible for the sensitizing dye to be first dissolved in a suitable solvent, such as methyl alcohol, ethyl alcohol, n-propyl alcohol, methyl cellosolve, acetone, water, pyridine, and a mixed solvent thereof, and then added to the emulsion in the form of a solution. For this dissolving, supersonic waves can also be used. In addition, for addition of the sensitizing dye, a method as described in U.S. Pat. No. 3,469,987 in which a dye is dissolved in a volatile organic solvent, the resulting solution is dispersed in a hydrophilic colloid, and the dispersion thus formed is added to an emulsion; a method as described in Japanese Patent Publication No. 24185/71 in which a water-insoluble dye is dispersed in a water-soluble solvent without dissolution, and the dispersion thus formed is added to an emulsion; a method as described in U.S. Pat. No. 3,822,135 in which a dye is dissolved in a surface active agent and the solution thus formed is added to an emulsion; a method as described in Japanese patent application (OPI) No. 74624/76 (the term "OPI" as used herein means a "published unexamined patent application") in which a compound causing a red shift is dissolved and the solution thus formed is added to an emulsion; a method as described in Japanese patent application (OPI) No. 80826/75 in which a dye is dissolved in an acid not substantially containing water and the solution thus formed is added to an emulsion; and so forth can be used. In addition, the methods described, for example, in U.S. Pat. Nos. 2,912,343, 3,342,605, 2,996,287, and 3,429,835, can also be used.

Any sensitizing dyes can be used in the present invention. For example, methine dyes such as cyanine dyes, merocyanine dyes, hemicyanine dyes, rhodacyanine dyes, oxonol dyes, and hemioxonol dyes, and styryl dyes can be used.

As spectrally sensitizing dyes, the dyes described in the following can be used. German Pat. No. 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, and 4,026,707, British Pat. Nos. 1,242,588, 1,344,281, and 1,507,803, Japanese Patent Publication Nos. 14030/69, 24844/77, 4936/68, and 12375/78, and Japanese patent application (OPI) Nos. 110618/77, 109925/77, and 80827/75.

Sensitizing dyes which are particularly suitable for use in the present invention are dyes having the maximum value of spectral sensitivity at from 650 to 750 nm. As examples of the dyes of M-band type, compounds represented by formulae (III) to (V) are described below, and as examples of the dyes of J-band type, the compound represented by formula (VI) is described below.

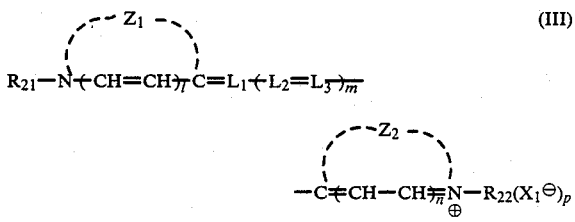

(III)

In the above formula (III), $Z_1$ and $Z_2$ each represents an atomic group forming a 5- or 6-membered heterocyclic ring, such as a benzooxazole nucleus, a benzoimidazole nucleus, a benzothiazole nucleus, a benzoselenazole nucleus, a benzotetrazole nucleus, and a quinoline nucleus, in which the benzene ring may be preferably substituted.

$L_1$, $L_2$, and $L_3$ each represents a methine group, which may be substituted. Preferred substituents are a methyl group, an ethyl group, a propyl group, a phenyl group, a benzyl group, a phenetyl group, and an atomic group forming a 4- to 6-membered ring between the methine groups.

$R_{21}$ and $R_{22}$ each represents an alkyl group which may be substituted, preferably an unsubstituted alkyl group such as a methyl group, an ethyl group, a butyl group, and a hexyl group; a carboxyalkyl group such as a carboxymethyl group, a 2-carboxyethyl group, and a 3-carboxypropyl group; a sulfoalkyl group such as 2-sulfoethyl group, a 3-sulfopropyl group, a 3-sulfobutyl group, and a 4-sulfobutyl group; a fluorinated alkyl group such as a 2,2,2-trifluoroethyl group and a 2,2,3,3,-tetrafluoropropyl group; a hydroxyalkyl group such as a 2-hydroxyethyl group and a 3-hydroxyethyl group; an alkoxyalkyl group such as a 2-methoxyethyl group, a 2-ethoxyethyl group, and a 3-methoxypropyl group; an aralkyl group such as a benzyl group, a 2-phenylethyl group, and a 2-(4-sulfophenyl)ethyl group; an aryloxyalkyl group such as a 2-phenoxyethyl group; and an acylaminoalkyl group such as a methanesulfonylaminoethyl group and an acetylaminoethyl group.

$X_1^{\ominus}$ represents a counter ion, preferably $Cl^{\ominus}$, $Br^{\ominus}$, $I^{\ominus}$, $ClO_4^{\ominus}$, p-toluenesulfonate, benzenesulfonate, p-chlorobenzenesulfonate, methylsulfate, ethylsulfate, and trifluoromethylsulfonate.

l and n are each 0 or 1 and m is 0, 1, or 2, provided that $l+m+n=2$.

p is 0 or 1. When $p=1$, the compounds of formula (III) form an intramolecular salt.

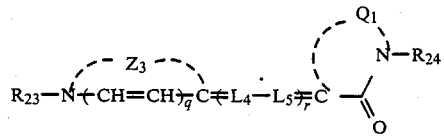

(IV)

In formula (IV), $Z_3$ is the same as $Z_1$ and $Z_2$.

$L_4$ and $L_5$ are the same as $L_1$, $L_2$, and $L_3$.

$R_{23}$ is the same as $R_{21}$ and $R_{22}$.

q is the same as l and n.

r is 1 or 2, provided that q+r=2.

$Q_1$ represents an atomic group forming a 5- or 6-membered heterocyclic ring. Examples of such 5- and 6-membered heterocyclic rings include a rhodanine nucleus, a 2-thiohydantoin nucleus, a 2-thiooxazolizine-4-one nucleus, a 2-pyrazoline-5-one nucleus, a barbituric acid nucleus, a 2-thiobarbituric acid nucleus, a thiazolidine-2,4-dione nucleus, a thiazolidine-4-one nucleus, an isooxazolone nucleus, a hydantoin nucleus, and an indandione nucleus.

Examples of an alkyl group, a substituted alkyl group, an aryl group, a substituted aryl group, and a heterocyclic group represented by $R_{24}$ include an alkyl group having from 1 to 18 carbon atoms, preferably from 1 to 7 carbon atoms, and particularly preferably from 1 to 4 carbon atoms (e.g., a methyl group, an ethyl group, a propyl group, an isopropyl group, a butyl group, an isobutyl group, a hexyl group, an octyl group, a dodecyl group, and an octadecyl group), a substituted alkyl group [such as an aralkyl group (e.g., a benzyl group and a 2-phenylethyl group), a hydroxyalkyl group (e.g., a 2-hydroxyethyl group and a 3-hydroxypropyl group), a carboxyalkyl group (e.g., a 2-carboxyethyl group, a 3-carboxypropyl group, a 4-carboxybutyl group, and a carboxymethyl group), an alkoxyalkyl group (e.g., a 2-methoxyethyl group and a 2-(2-methoxyethoxy)ethyl group), a sulfoalkyl group (e.g., a 2-sulfoethyl group, a 3-sulfopropyl group, a 3-sulfobutyl group, a 4-sulfobutyl group, a 2-(3-sulfopropoxy)ethyl group, a 2-hydroxy-3-sulfopropyl group, and a 3-sulfopropoxyethoxyethyl group), a sulfitealkyl group (e.g., a 3-sulfitepropyl group and a 4-sulfitebutyl group), a heterocyclic group-substituted alkyl group (e.g., a 2-(pyrolidine-2-on-1-yl)ethyl group, a tetrahydrofuryl group, and a 2-morpholinoethyl group), a 2-acetoxyethyl group, a carbomethoxymethyl group, a 2-methanesulfonylaminoethyl group, and an allyl group)], an aryl group (e.g., a phenyl group and a 2-naphthyl group), a substituted aryl group (e.g., a 4-carboxyphenyl group, 4-sulfophenyl group, a 3-chlorophenyl group, and a 3-methylphenyl group), and a heterocyclic group (e.g., a 2-pyridyl group and a 2-thiazolyl group).

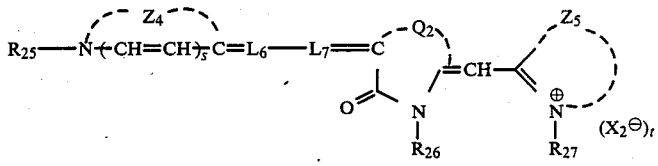

(V)

In formula (V), $Z_4$ and $Z_5$ are the same as $Z_1$ and $Z_2$.

$L_6$ and $L_7$ are the same as $L_1$, $L_2$, and $L_3$.

$R_{25}$ and $R_{27}$ are the same as $R_{21}$ and $R_{22}$.

$Q_2$ represents an atomic group forming a 5- or 6-membered heterocyclic ring, and the heterocyclic ring formed is equivalent to a ring resulting from removal of an oxo group of thiooxo group at a suitable position from the heterocyclic ring represented by $Q_1$.

$R_{26}$ is the same as $R_{24}$.

$X_2^{\ominus}$ is the same as $X_1^{\ominus}$.

t is the same as p.

s is 0 or 1.

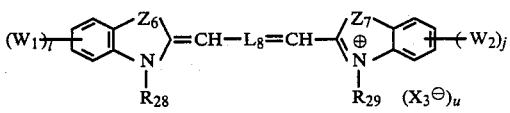

(VI)

In formula (VI), $Z_6$ and $Z_7$ are each S, Se, or Te.

$W_1$ and $W_2$ each represents a substituent. Preferred examples of the substituent include a halogen atom, an alkyl group, an alkoxy group, an aryl group, an aryloxy group, and a condensed benzene ring.

$L_8$ is the same as $L_1$, $L_2$, and $L_3$.

$R_{28}$ and $R_{29}$ are the same as $R_{21}$ and $R_{22}$.

$X_3^{\ominus}$ is the same as $X_1^{\ominus}$.

i and j are each 0, 1, or 2.

u is the same as p.

Representative examples of the above compounds are shown below.

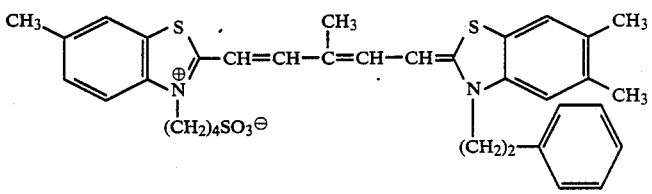

III-1

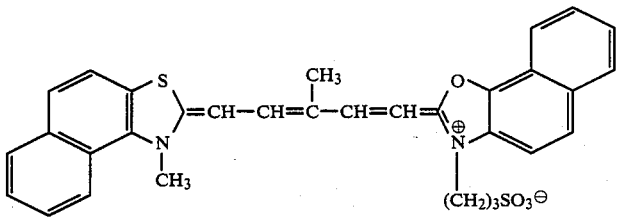

III-2

-continued
III-3
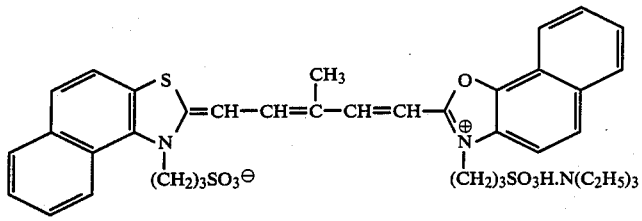
III-4
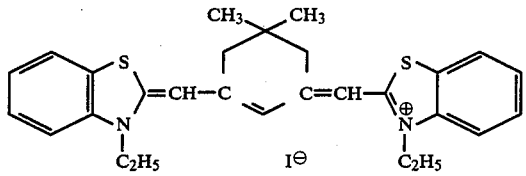
III-5
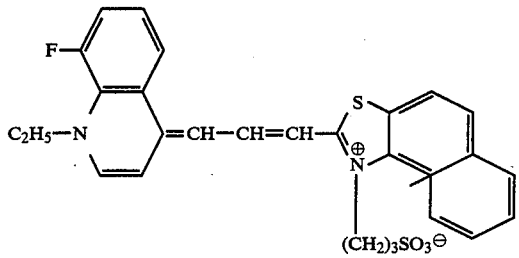
III-6
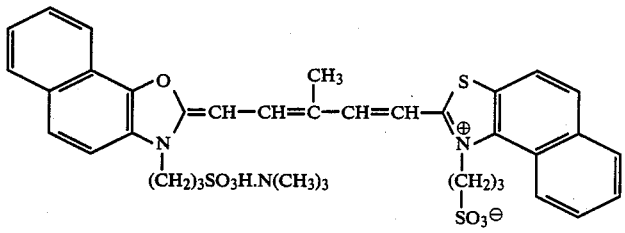
IV-1
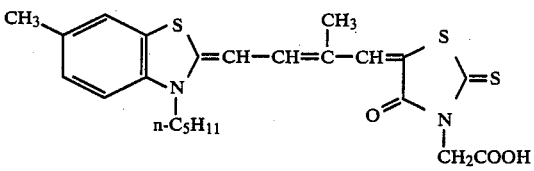
IV-2
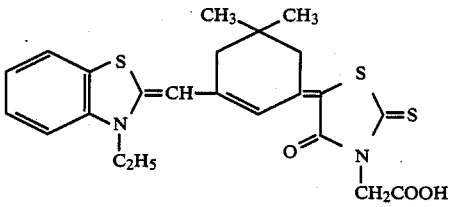
IV-3
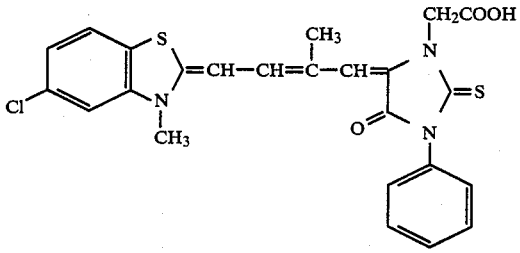

-continued
N-4
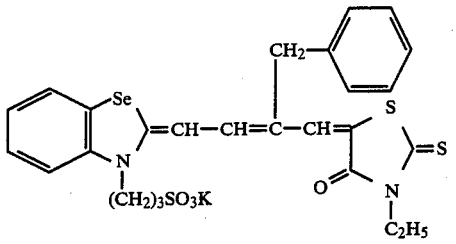
IV-5
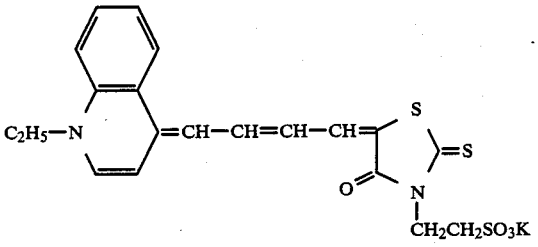
V-1
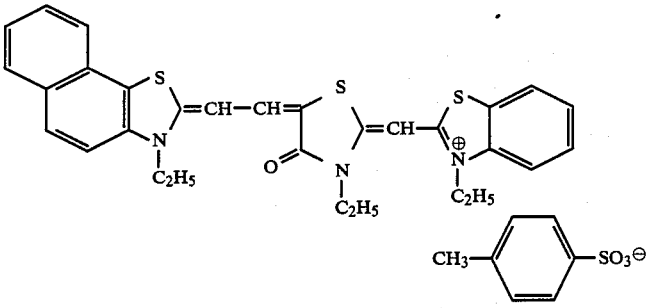
V-2
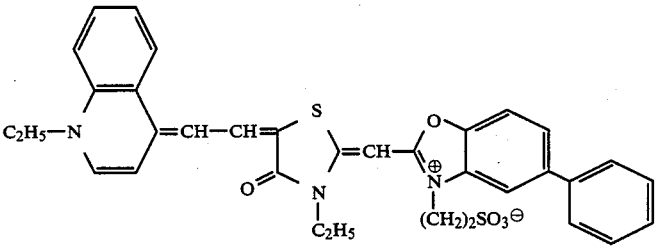
V-3
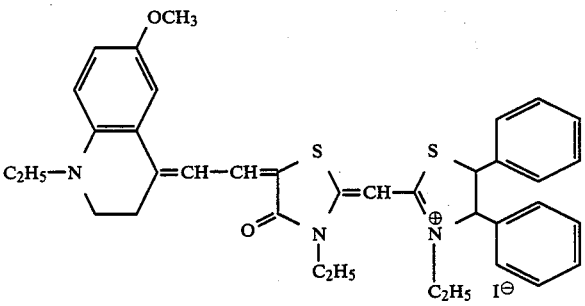
V-4
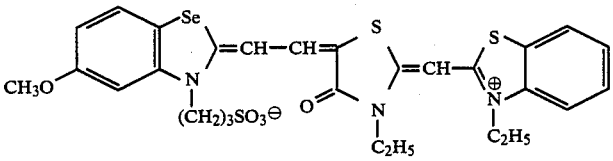

-continued

V-5

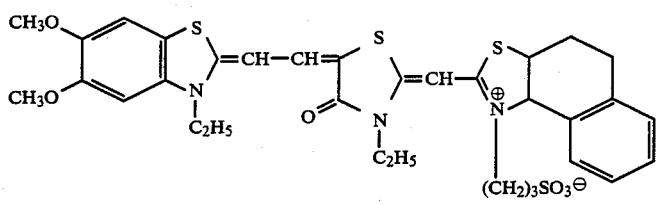

VI-1

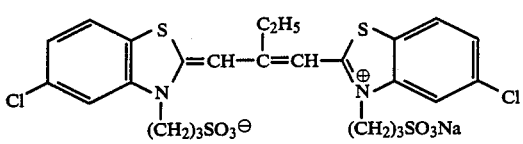

VI-2

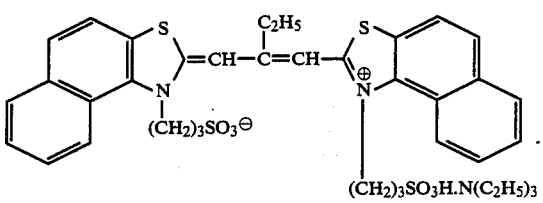

VI-3

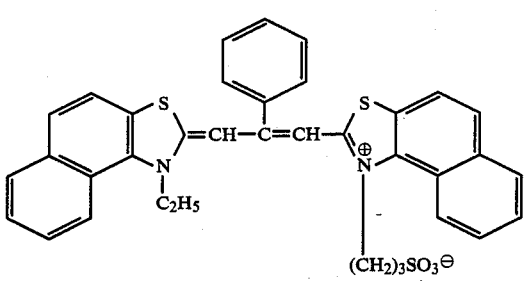

VI-4

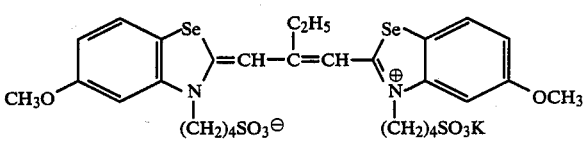

VI-5

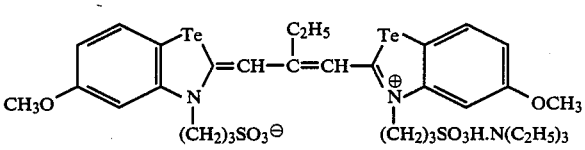

Sensitizing dyes which are used in the present invention can be easily prepared with reference to F. M. Hamer, *Heterocyclic Compounds-Cyanine Dyes and Related Compounds*, Chapter 5, pp. 116–147, John Wiley & Sons, New York, London (1964), Japanese patent application (OPI) No. 78445/85 and so forth.

An amount of the sensitizing dyes which are used in the present invention is preferably from $2\times10^{-5}$ to $2\times10^{-3}$ mol, and more preferably from $1\times10^{-5}$ to $2.5\times10^{-5}$ mol, per mol of silver halide in the silver halide emulsion.

When the above sensitizing dyes are incorporated in the silver halide emulsion singly, dye fogging sometimes occurs. In this case, it is preferred that the compounds represented by formula (II) as described below (the compounds substantially do not have spectral absorption in the visible region and have a strong absorption in the near infrared region) are added to the silver halide emulsion in combination with the above sensitizing dyes because the use of the compounds of formula (II) in combination with the sensitizing dyes efficiently inhibits dye fogging with almost no reduction in spectral sensitivity and significantly prevents the reduction of spectral sensitivity which will occur with a lapse of time.

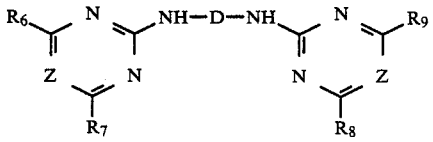

(II)

wherein Z represents —CH= or —N=; —D— represents a divalent aromatic residual group (e.g., a single aromatic residue, a residue derived from at least two aromatic nuclei through condensation, a residue resulting from combination of at least two aromatic nuclei directly or through an atom or an atomic group; in more detail, a biphenyl group, a naphthylene group, a stilbene group, a bibenzyl group, and the like), particularly preferably the groups represented by the following —$D_1$— and —$D_2$— —$D_1$—

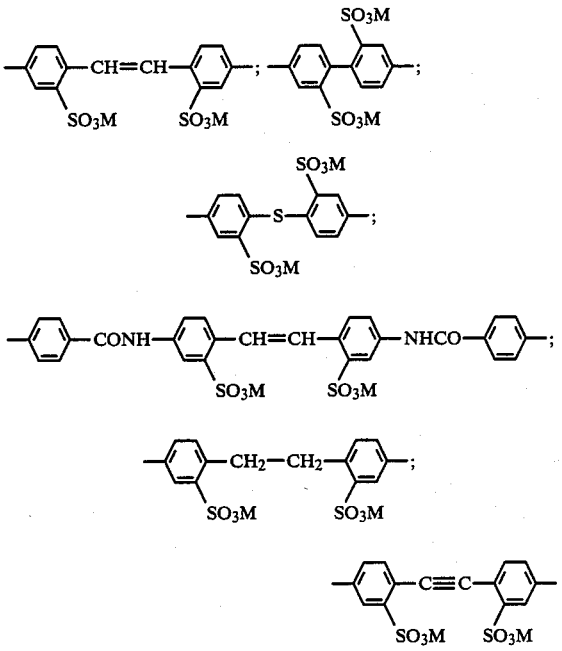

wherein M represents a hydrogen atom or a cation imparting watersolubility (e.g., alkali metal ions such as $Na^{\oplus}$ and $K^{\oplus}$, and ammonium ion).

—$D_2$—

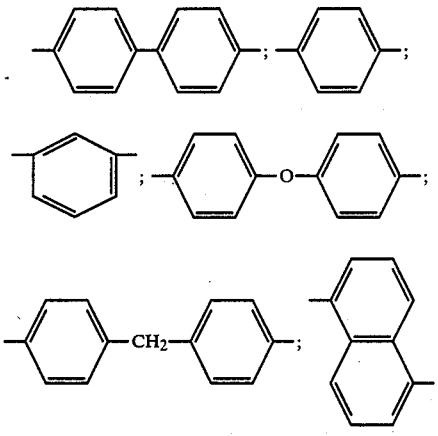

wherein at least one of $R_6$, $R_7$, $R_8$, and $R_9$ has a substituent containing —$SO_3M$ and M is the same as defined above.

$R_6$, $R_7$, $R_8$, and $R_9$ each represents a hydrogen atom, a hydroxyl group, an alkoxyl group (e.g., a methoxy group and an ethoxy group), an aryloxy group (e.g., a phenoxy group, a naphthoxy group, an o-tolyloxy group, and a p-sulfophenoxy group), a halogen atom (e.g., a chlorine atom and a bromine atom), a heterocyclic group (e.g., a morpholino group and a piperidino group), a mercapto group, an alkylthio group (e.g., a methylthio group and an ethylthio group), an arylthio group (e.g., a phenylthio group and a tolythio group), a heterocyclylthio group (e.g., a benzothiozolylthio group, a benzoimidazolylthio group, and a phenyltetrazoylthio group), an amino group, an alkylamino group (e.g., a methylamino group, an ethylamino group, a propylamino group, a dimethylamino group, a diethylamino group, a dodecylamino group, a β-hydroxyethylamino group, a di-β-hydroxyethylamino group, and a β-sulfoethylamino group), a cyclohexylamino group, an arylamino group (e.g., an anilino group, an o-, m-, or p-sulfoanilino group, an o-, m-, or p-chloroanilino group, an o-, m-, or p-anicidino group, an o-, m-, or p-tolyidino group, an o-, m-, or p-carboxyanilino group, a hydroxyanilino group, a sulfonaphthylamino group, an o-, m-, or p-aminoanilino group and an o-acetaminoanilino group), a heterocyclylamino group (e.g., a 2-benzothiazolylamino group and a 2-pyridylamino group), an aryl group (e.g., a phenyl group), and an aralkylamino group (e.g., a benzylamino group). Of the compounds represented by formula (II), compounds in which at least one of $R_5$ to $R_8$ is an aryloxy group, an arylamino group, a heterocyclylthio group, or a heterocyclylamino group are particularly preferred.

When antifoggants or stabilizers which are commonly used to prevent dye fogging which will occur when the sensitizing dyes are incorporated in the emulsion singly are incorporated, a decrease in sensitivity usually occurs concurrently with the action of fog prevention, and thus a reduction in contrast (i.e., a soft tone) occurs. However, when the compounds of formula (II) are used, unexpectedly, a reduction in contrast as encountered in preventing dye fogging does not occur and in some cases an increase in contrast occurs. The compounds of formula (II) which are used in combination to prevent fogging due to sensitizing dyes increase the spectral sensitivity depending on the type thereof, but usually the spectral sensitivity hardly changes or drops only slightly.

Representative examples of the compounds represented by formula (II) are shown below.

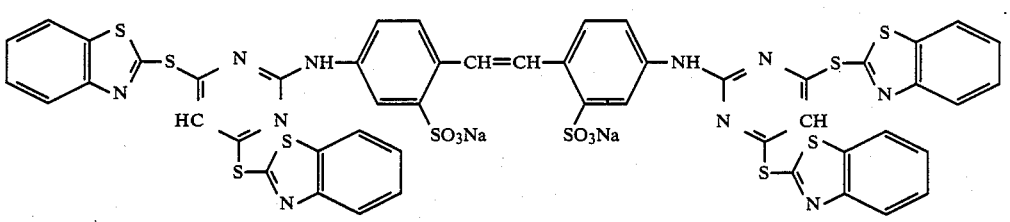

II-1

-continued
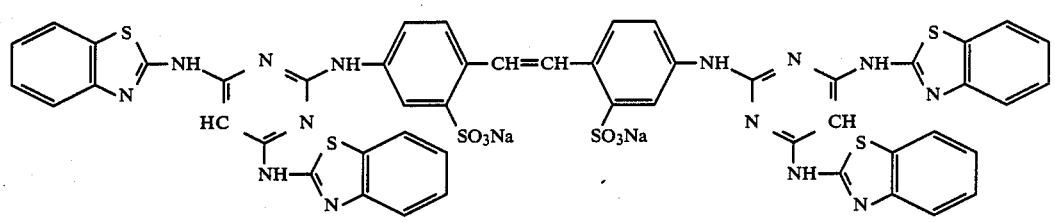
II-2
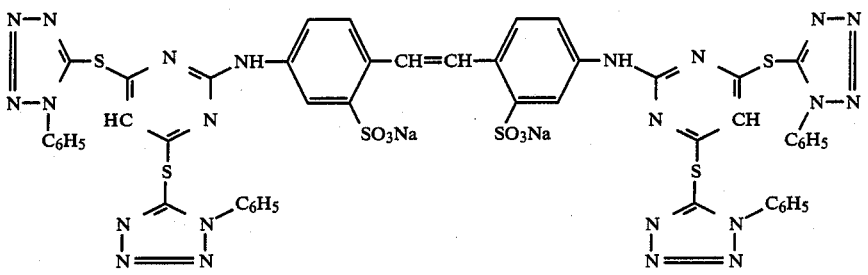
II-3
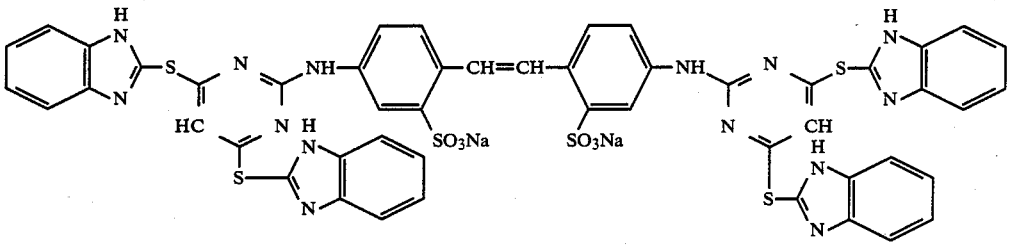
II-4
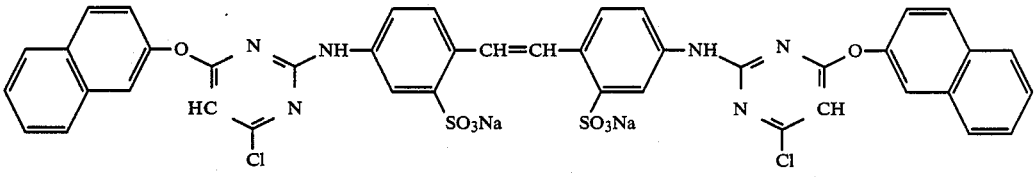
II-5
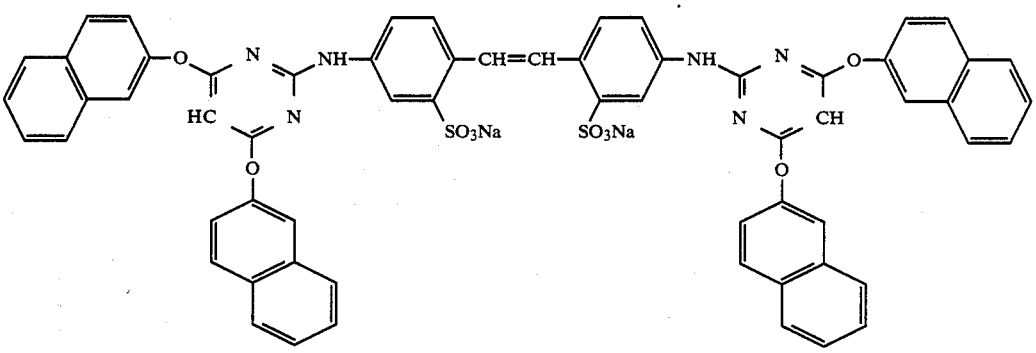
II-6

-continued
II-7
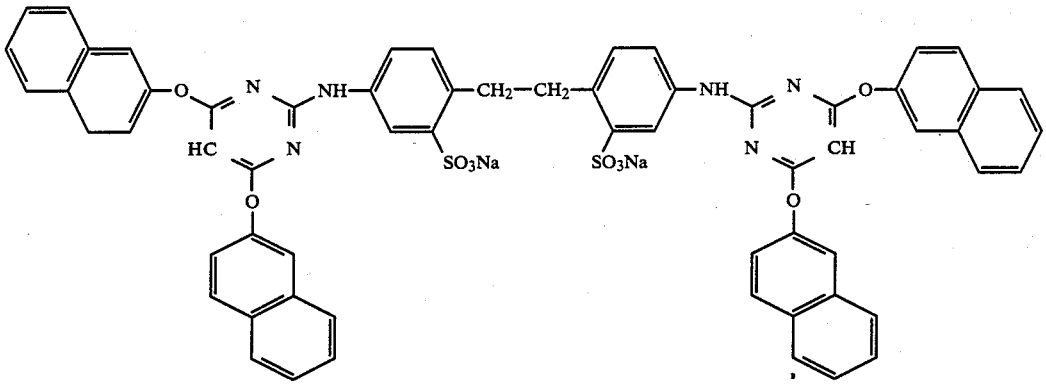
II-8
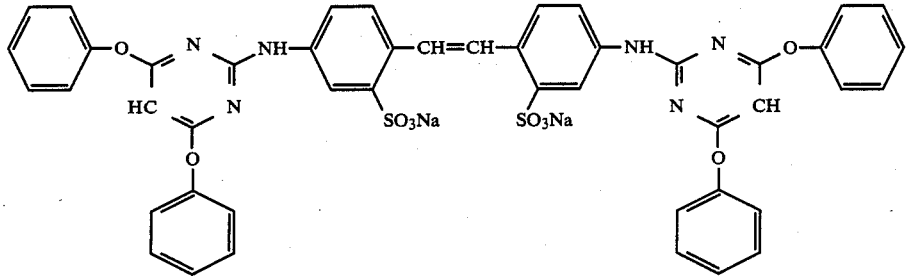
II-9
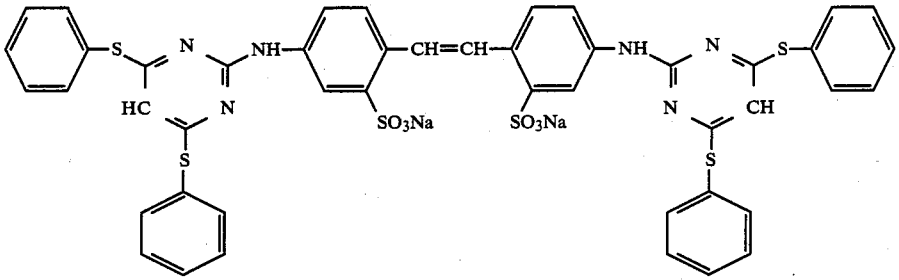
II-10
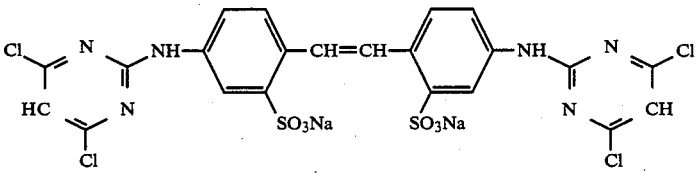
II-11
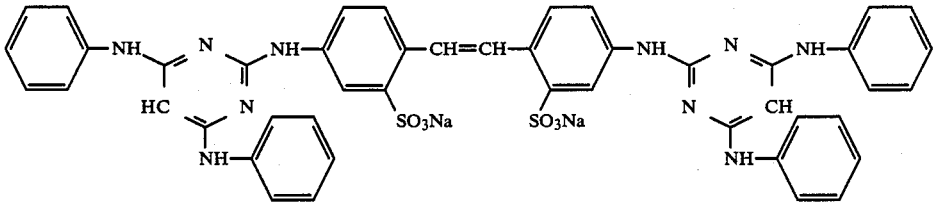
II-12
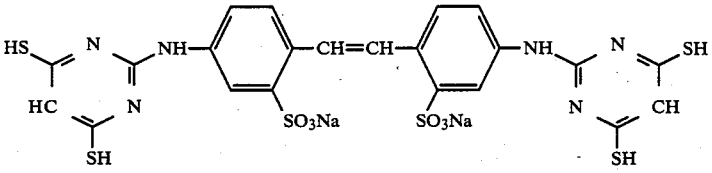

-continued

II-13

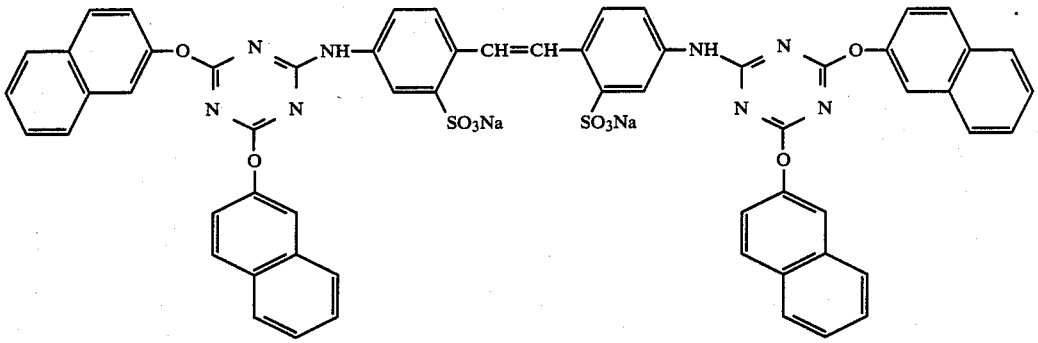

II-14

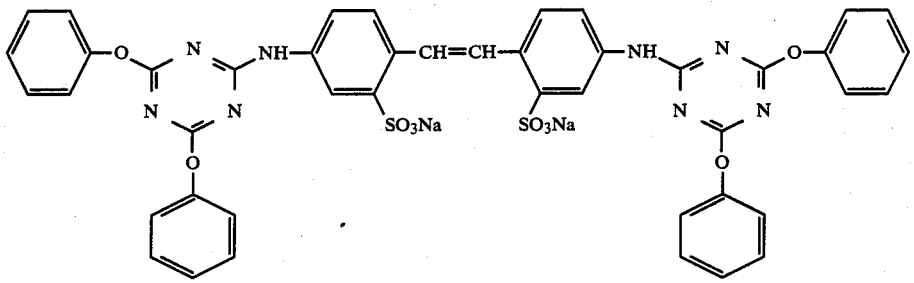

II-15

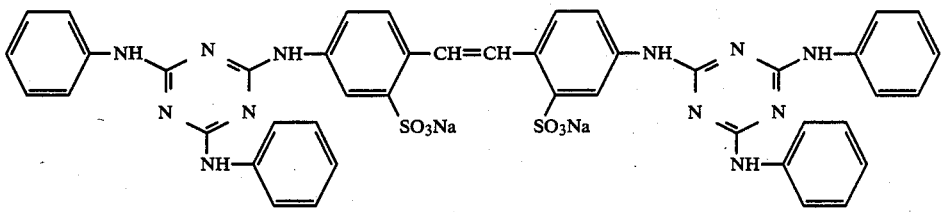

The compounds of formula (II) which are used in the present invention can be easily prepared by one skilled in the art by referring to Japanese Patent Publication No. 32741/70. Compounds not specifically disclosed therein can also be prepared in an analogous manner as described therein.

When the compound of formula (II) is used in combination with the sensitizing dye, the compound can be added in such a wide range of amount that the dye fogging preventing action, the action of preventing the deterioration with a lapse of time of spectral sensitivity, and the diffusion sensitizition preventing action can be obtained.

The compound of formula (II) is advantageously used in a concentration of from about 0.01 to about 5 grams, and more preferably from about 0.2 to about 4 grams, per mol of silver halide in the emulsion.

When the compound of formula (II) is used in combination with the sensitizing dye, the weight ratio of the sensitizing dye to the compound of formula (II) (sensitizing dye/compound of formula (II)) is preferably from ½ to 1/200, and particularly preferably from 1/5 to 1/100.

It is preferred for the compound of formula (II) to be added to the silver halide emulsion like the sensitizing dye. For this addition of the compound of formula (II), the same methods as in the sensitizing dye can be employed.

The compound of formula (II) and the sensitizing dye can be added to the emulsion separately or in combination with each other.

As silver halide to be used in the emulsion of the present invention, any of silver chloride, silver bromide, silver iodide, silver chlorobromide, silver iodobromide, silver chloroiodobromide, and the like can be used.

In the silver halide emulsion of the present invention, gelatin is usually used as a vehicle. In place of gelatin, substances not exerting harmful influences on the light-sensitive silver halide, such as gelatin derivatives (e.g., acylated gelatin), albumin, agar, gum arabic, alginic acid, hydrophilic resins (e.g., polyvinyl alcohol and polyvinylpyrrolidone), and cellulose derivatives, can be used.

These emulsions may be composed of coarse particles or fine particles or a mixture of coarse and fine particles. These silver halide particles can be prepared by known techniques such as the single jet method, the double jet method, and the controlled double jet method.

Silver halide particles may have a crystal structure that is uniform throughout the inside, or a layer-shaped crystal structure that is different between the inside and the outer layer, or a conversion type crystal structure as described in British Pat. No. 635,841 and U.S. Pat. No. 3,622,318. In addition, the silver halide particles may be of the type that a latent image is formed mainly on the surface, or of the inside latent image type that the latent image is formed in the inside of the particles. These photographic emulsions are described, for example, in Mees, *The Theory of Photographic Process*, MacMillan, and Glafkides, *Photographic Chemistry*, Fountain Press, and can be prepared by known techniques such as the ammonia method, the neutral method, and the acid method. These silver halide particles are washed with water after the formation thereof to remove by-produced water-soluble salts (e.g., potassium nitrate when silver bromide is formed from silver nitrate and potassium bromide), and then are subjected to heat treatment in the presence of a chemical sensitizer to increase the sensitivity without coarsening the particles. The silver halide particles may be used as such without removing such water-soluble salts. Methods generally used for such removal of water-soluble salts are described in the above-cited references.

The average diameter of silver halide particles (as determined, for example, by the projected area method and the method utilizing a number average) is generally from about 0.04 μm to about 4 μm, preferably from about 0.1 μm to about 5 μm, and more preferably from about 0.2 μm to about 2 μm.

At the time of formation of silver halide particles, as silver halide solvents to control the growth of the particles, compounds such as ammonia, rhodan potash, rhodan ammonium, and thioether compounds as described in U.S. Pat. Nos. 3,271,157, 3,574,628, 3,704,130, 4,297,439, and 4,276,374, thione compounds as described, for example, in Japanese patent application (OPI) Nos. 144319/78, 82408/78, and 77737/80, and amine compounds as described, for example, in Japanese patent application (OPI) No. 100717/79 can be used.

Silver halide photographic emulsions can be sensitized by various chemical sensitizing methods that are commonly used, such as gold sensitization (described, for example, in U.S. Pat. Nos. 2,540,085, 2,597,876, 2,597,915, and 2,399,083), sensitization using Group VIII metal ions (described, for example, in U.S. Pat. Nos. 2,448,060, 2,540,086, 2,566,245, 2,566,263, and 2,598,079), sulfur sensitization (described, for example, in U.S. Pat. Nos. 1,574,944, 2,278,947, 2,440,206, 2,410,689, 3,189,458, and 3,415,649), reduction sensitization (described, for example, in U.S. Pat. Nos. 2,518,698, 2,419,974, and 2,983,610), sensitization using thioether compounds (described, for example, in U.S. Pat. Nos. 2,521,926, 3,021,215, 3,038,805, 3,046,129, 3,046,132, 3,046,133, 3,046,134, 3,046,135, 3,057,724, 3,062,646, 3,165,552, 3,189,458, 3,192,046, 3,506,443, 3,671,260, 3,574,709, 3,625,697, 3,635,717, and 4,198,240), and composite methods thereof.

As representative chemical sensitizers, sulfur sensitizers such as allylthiocarbamide, thiourea, sodium thiosulfate, and cystine; noble metal sensitizers such as potassium chloroaurate, aurous thiosulfate, and potassium chloropalladate, and reducing sensitizers such as tin chloride, phenylhydrazine, and reductone can be used.

In addition, sensitizers such as polyoxyethylene derivatives (as described, for example, in British Pat. No. 981,470, Japanese Patent Publication No. 6475/56 and U.S. Pat. No. 2,716,062), polyoxypropylene derivatives, derivatives containing a quaternary ammonium group and the like can be used.

Various compounds can be added to the photographic emulsions of the present invention to prevent a reduction in sensitivity and the formation of fog during the process of preparation, the storage or the processing thereof. As these compounds, a number of compounds such as heterocyclic compounds (e.g., nitrobenzimidazole, ammonium chloroplatinate, 4-hydroxy-6-methyl-1,3,3a,7-tetraazaindene, 3-methylbenzothiazole, and 1-phenyl-5-mercaptotetrazole), mercury-containing compounds, mercapto compounds, and metal salts are known. Some compounds which can be used are described in Mees, *The Theory of the Photographic Process*, 4th Ed., Macmillan Publishing Co., 1977, pp. 344–349, and original reference listed therein. In addition, thiazolium salts as described in U.S. Pat. Nos. 2,131,038 and 2,694,716; azaindenes as described in U.S. Pat. Nos. 2,886,437 and 2,444,605; urazoles as described in U.S. Pat. No. 3,287,135; sulfocatechols as described in U.S. Pat. No. 3,236,652; oxims as described in British Pat. No. 623,448; mercaptotetrazoles as described in U.S. Pat. Nos. 2,403,927, 3,266,897, and 3,397,987; nitron; nitroindazoles; polyvalent metal salts as described in U.S. Pat. No. 2,839,405; thiuronium salts as described in U.S. Pat. No. 3,220,839; and the salts of palladium, platinum, and gold as described in U.S. Pat. Nos. 2,566,263 and 2,587,915 can be used.

The silver halide photographic emulsion of the present invention can contain, in addition to the compounds of formula (I), color couplers such as cyan, magenta, and yellow couplers, and compounds for dispersing the couplers.

That is, the silver halide photographic emulsion may contain compounds capable of forming color through oxidative coupling with an aromatic primary amine developer (e.g., phenylenediamine derivatives and aminophenol derivatives) at the color developing processing step. For example, as magenta couplers, a 5-pyrazolone coupler, a pyrazolobenzimidazole coupler, a cyanoacetylcumarone coupler, a open-chain acylacetonitrile coupler, and the like can be used; as yellow couplers, an acylacetoamide coupler (e.g., benzoylacetoanilides and pivaloylacetoanilides) and the like can be used; and as cyan couplers, a naphthol coupler and a phenol coupler can be used. It is desirable for these couplers to have a hydrophobic group, referred to as a ballast group in the molecule thereof, so that they are non-diffusing. These couplers may be 4-equivalent or 2-equivalent relative to silver ion. In addition, colored couplers having an action of color correction and couplers releasing a development inhibitor with development (i.e., so-called DIR couplers) can be used.

The silver halide photographic emulsion of the present invention may also contain non-color-forming DIR couplers which provide a colorless product by the coupling reaction and which release a development inhibitor.

Two or more of the above couplers can be used in combination in the same layer to satisfy the characteristics required for the light-sensitive material, or as a matter of course, the same compound can be added to two or more different layers.

The above couplers include couplers containing a water-soluble group (e.g., a carboxyl group, a hydroxyl group, and a sulfo group), and hydrophobic couplers. These couplers are incorporated in the emulsion by the addition method or the dispersion method which have heretofore been known. In the case of hydrophobic couplers, a method in which a high boiling point organic solvent such as phthalic acid esters, trimellitic acid esters, phosphoric acid esters, and fatty ols and waxes which are liquid at ordinary temperature, and a coupler are mixed and then are dispersed by the aid of an anionic surface active agent; a method as described in U.S. Pat. Nos. 2,304,939 and 2,322,027; a method in which a low boiling organic solvent or a water-soluble organic solvent and a coupler are mixed and then dispersed; a method as described in U.S. Pat. Nos. 2,801,170, 2,801,171, and 2,949,360; a method in which a coupler having sufficiently low melting point (preferably 75° C. or less) is dispersed alone or in combination with other couplers such as a colored coupler, and a DIR coupler; and a method as described in German Pat. No. 1,143,707 can be employed. Water-soluble couplers can be added in the form of an alkali solution, or in combination with hydrophobic couplers as aids for dispersion of the hydrophobic couplers (as one of anionic surface active agents).

Moreover, a color image can be formed by developing with a color developer containing a diffusible coupler.

In the present invention, usually, emulsions which have been subjected to physical ripening, chemical ripening, and spectral sensitization are used. Additives (including those described above) which are used in these steps are described in *Research Disclosure*, Vol. 176, RD No. 17643 (December, 1978) and ibid., Vol. 187, RD No. 18716 (November, 1979), and the corresponding pages are listed in the table below.

| Type of Additive | RD No. 17643 | RD No. 18716 |
|---|---|---|
| 1. Chemical sensitizer | P. 23 | P. 648, right col. |
| 2. Sensitivity-accelarator | P. 23 | P. 648, right col. |
| 3. Spectral sensitizer | pp. 23–24 | P. 648, right col. to p. 649, right col. |
| 4. supersensitizer | pp. 23–24 | P. 648, right col. to p. 649, right col. |
| 5. Brightening agent | p. 24 | P. 648, right col. to p. 649, right col. |
| 6. Antifoggant or stabilizer | pp. 24–25 | p. 649, right col. |
| 7. Coupler | p. 25 | p. 649, right col. |
| 8. Organic solvent | p. 25 | p. 649, right col. |
| 9. Light absorber, filter dye | pp. 25–26 | p. 649, right col. to p. 650, left col. |
| 10. Ultraviolet ray absorber | pp. 25–26 | p. 649, right col. to p. 650, left col. |
| 11. Stain preventing agent | p. 25, right col. | p. 650, left to right col. |
| 12. Dye image stabilizer | p. 25 | p. 650, left to right col. |
| 13. Hardening agent | p. 26 | p. 651, left col. |
| 14. Binder | p. 26 | p. 651, left col. |
| 15. Plasticizer, lubricant | p. 27 | p. 650, right col. |
| 16. Coating aid, surface active agent | pp. 26–27 | p. 650, right col. |
| 17. Antistatic agent | p. 27 | p. 650, right col. |

The present invention can be applied for the sensitization of a silver halide emulsion which is used in various color light-sensitive materials. These silver halide emulsions include an emulsion for a color positive film, an emulsion for a color paper, an emulsion for a color negative film, an emulsion for color reversal film (sometimes including a coupler or sometimes not including a coupler), and an emulsion for a color diffusion transfer process.

Light exposure to obtain a photographic image can be carried out by the usual method, that is, any one of a number of known light sources such as natural light (sun light), a tungsten lamp, a fluorescent lamp, a mercury lamp, a xenon arc lamp, a carbon mark lamp, a xenon flash lamp, and a cathode ray flying spot. The exposure time may be from 1/1,000 second to 1 second, which is used in a conventional camera, or shorter than 1/1,000 second, for example, from $1/10^4$ to $1/10^6$ second, used in the case of a xenon flash lamp or a cathode ray tube, or longer than 1 second. If desired, a color filter can be used to control the spectral composition of light for use in light exposure. For the light exposure, a laser light can also be used. Furthermore, light released from a fluorescent body excited by an electron beam, X-rays, $\gamma$-rays, or an $\alpha$-rays can also be used.

The layer arrangement of a multi-layer color light-sensitive material which can be used in the present invention is not critical. For example, a blue-sensitive layer (B), a green-sensitive layer (G), and a red-sensitive layer (R) may be provided on a support in this sequence. They may be coated in the order of (R), (G), and (B). Moreover, they may be coated in the order of (B), (R), and (G). In the case that they are coated in the order of (R), (G), and (B), it is desirable that a yellow filter layer is provided between (G) and (B).

Photographic emulsions which are used in the present invention are coated on a support as described in *Research Disclosure*, Vol. 176, RD No. 17643 (December, 1978), Chapter XVII, by a method as described in ibid., Chapter XV, to thereby produce a light-sensitive material.

Photographic processing of the light-sensitive material as produced by the present invention can be carried out by any known methods. In this photographic processing, known processing solutions can be used. The processing temperature is chosen from the range of from 18° C. to 50° C. Temperatures lower than 18° C. or temperatures higher than 50° C. can also be used.

In detail, development can be carried out by the methods described in *Research Disclosure*, Vol. 176, RD No. 17643, pp. 28–29 and ibid., Vol. 187, RD No. 18716, p. 651, from left to right column.

The present invention is described in greater detail with reference to the following examples.

EXAMPLE 1

On a cellulose triacetate support were coated the following first layer (lowermost layer) to sixth layer (uppermost layer) to prepare a multi-layer color light-sensitive film as shown in Table 1. In this way, Samples 1 to 12 were prepared. In Table 1, the unit mg/m² indicates a coated amount.

TABLE 1

| | |
|---|---|
| Sixth Layer (Protective Layer) | |
| Gelatin | 750 mg/m² |
| Fifth Layer (Green-Sensitive Layer) | |
| Silver chlorobromide emulsion (silver coverage) (silver bromide: 30 mol %; average diameter of silver chlorobromide particle: 0.3 μm) | 500 mg/m² |
| Gelatin | 1,300 mg/m² |
| Potassium bromide | 5 mg/m² |
| Sensitizing dye (*1) | 2.1 mg/m² |
| Magenta coupler (*2) | 600 mg/m² |
| Coupler solvent (*3) | 110 mg/m² |
| Fourth Layer | |
| Gelatin | 500 mg/m² |
| Third Layer (Red-Sensitive Layer) | |
| Silver chlorobromide emulsion (silver coverage) (silver bromide: 30 mol %; average diameter of silver chlorobromide particle: 0.3 μm) | 500 mg/m² |
| Gelatin | 2,900 mg/m² |
| Sensitizing dye (*4) | See Table 2 |
| Cyan coupler (*5) | " |
| Coupler solvent (*6) | 700 mg/m² |
| Second Layer | |
| Gelatin | 500 mg/m² |
| First Layer (Blue-Sensitive Layer) | |
| Silver iodobromide emulsion (silver coverage) (silver iodide: 0.2 mol %; average diameter of silver iodobromide particle: 0.6 μm) | 1,000 mg/m² |
| Gelatin | 2,200 mg/m² |
| Sensitizing dye (*7) | 2.0 mg/m² |
| Yellow coupler (*8) | 1,200 mg/m² |

TABLE 1-continued

| | |
|---|---|
| Coupler solvent (*9) | 600 mg/m² |

Support
Cellulose triacetate

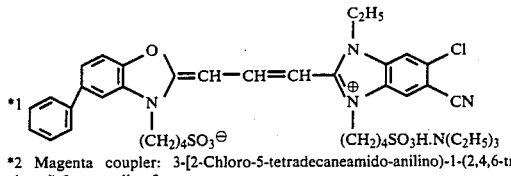

*2 Magenta coupler: 3-[2-Chloro-5-tetradecaneamido-anilino)-1-(2,4,6-trichloro-phenyl)-2-pyrazoline-5-one
*3 Coupler solvent: Cresyl phosphate
*4 Sensitizing dye: Used according to Samples 1 to 12 shown in Table 2
*5 Cyan coupler: Used according to Samples 1 to 12 shown in Table 2
*6 Coupler solvent: Dibutyl phthalate (60 wt % ) and 2,4-di-tert-amylphenol (40 wt %)
*7 Sensitizing dye: 3-Phenyl-5-[3-(3-fluoropropyl)-2-benzoxazolilidene]rhodanine sodium salt
*8 Yellow coupler: α-(4-methoxybenzoyl)-α-(3-benzyl-4-ethoxyhydantoin-1-yl)-2-chloro-5-dodecyl-oxycarbonylacetoanilide
*9 Coupler solvent: Dibutyl phthalate In the third layer, as shown in Table 2, the total amount of a red-sensitive sensitizing dye as shown below and the total amount of a compound represented by formula (II) were added at a point that 90% of particles were formed, and the red-sensitive silver chlorobromide emulsion thus prepared was used in combination with a cyan coupler represented by formula (I).

The determination of the diffusion sensitization into the adjacent layer was carried out as follows:

After storage at room temperature or under high temperature and high humidity conditions (i.e., 50° C., 80% RH) for 2 days, the optical density ($D_G$) of a magenta colored image at an exposure amount providing the maximum density Dmax of a cyan colored image at a red expose area was measured. Based on this the optical density $D_G$, the diffusion sensitization was evaluated. As the $D_G$ value is smaller, the diffusion sensitization is preferably more reduced.

As apparent from the results of Table 2, the method of preparation of the present invention (Sample Nos. 4–6 and 10–12) provided a light-sensitive material which was of sufficiently high sensitivity, was reduced in the diffusion sensitization to the adjacent layer even after storage under high temperature and high humidity conditions, and which was sufficiently prevented in developing fog, i.e., contamination due to color development as compared with the comparative examples (Sample Nos. 1–3 and 7–9).

EXAMPLE 2

On a paper support laminated with polyethylene on both sides were coated the following first layer (lowermost layer) to sixth layer (uppermost layer) in this order to prepare a color photographic light-sensitive materials (Samples 21 to 26). In Table 3, the unit mg/m² represents a coated amount.

TABLE 3

| | |
|---|---|
| Sixth Layer (Protective Layer) | |
| Gelatin | 1,600 mg/m² |
| Fifth Layer (Red-Sensitive Layer) | |
| Silver chlorobromide emulsion (silver coverage) (silver bromide: 50 mol %: average diameter of silver chlorobromide particle: 0.4 μm) | 300 mg/m² |
| Sensitizing dye III-1 | 0.05mg/m² |
| Cyan coupler (*2) | 400 mg/m² |
| Coupler solvent (*3) | 300 mg/m² |
| Gelatin | 500 mg/m² |
| Fourth layer (ultraviolet Absorbing Layer) | |
| Ultraviolet absorbing agent (*4) | 600 mg/m² |
| Solvent for the ultraviolet absorbing agent (*3) | 300 mg/m² |
| Gelatin | 800 mg/m² |
| Third Layer (Green Sensitive Layer) | |
| Silver chlorobromide emulsion (silver coverage) | 500 mg/m² |

TABLE 2

| | Sensitizing Dye | | | Compound I | | Compound II | | | | Density due to Diffusion Sensitization to Adjacent Layer ($D_G$) | |
|---|---|---|---|---|---|---|---|---|---|---|---|
| Sample No. | Added Amount × $10^{-7}$ mol/m² | Adding Method | | Added Amount (mg/m²) | Added Amount (mg/m²) | Adding Method | Sensitivity Relative Value | Development Fog | Storage at Room Temperature for 2 Days | Storage at 50° C., 80% RH for 2 Days |
| 1* | III-2 3.45 | Prior to coating | I-3 | 1.50 | — | Prior to coating | 41 | 0.07 | 0.03 | 0.05 |
| 2* | " | Prior to coating | " | | II-6 | 7.8 Prior to coating | 43 | 0.06 | 0.03 | 0.06 |
| 3* | III-2 5.18 | Prior to coating | " | | " | Prior to coating | 40 | 0.06 | 0.04 | 0.07 |
| 4 | III-2 3.45 | During particle formation | " | | — | During particle formation | 48 | 0.07 | 0.02 | 0.02 |
| 5 | " | During particle formation | " | | II-6 | 7.8 During particle formation | 52 | 0.05 | 0.03 | 0.03 |
| 6 | III-2 5.18 | During particle formation | " | | " | During particle formation | 50 | 0.05 | 0.04 | 0.05 |
| 7* | III-6 3.45 | Prior to coating | I-3 | 1.60 | — | Prior to coating | 101 | 0.10 | 0.10 | 0.35 |
| 8* | " | Prior to coating | " | | II-6 | 7.8 Prior to coating | 111 | 0.06 | 0.12 | 0.36 |
| 9* | III-6 5.18 | Prior to coating | " | | " | Prior to coating | 126 | 0.07 | 0.24 | 0.58 |
| 10 | III-6 3.45 | During particle formation | I-1 | 1.60 | — | During particle formation | 106 | 0.08 | 0.02 | 0.04 |
| 11 | " | During particle formation | " | | II-6 | 7.8 During particle formation | 121 | 0.04 | 0.03 | 0.03 |
| 12 | III-6 5.18 | During particle formation | " | | " | During particle formation | 141 | 0.05 | 0.03 | 0.05 |

(Note)
*Comparative examples

TABLE 3-continued

| | |
|---|---|
| (silver bromide: 70 mol %; average diameter of silver chlorobromide particle: 0.5 μm) | |
| Magenta coupler (*5) | 400 mg/m$^2$ |
| Anti-fading agent (*6) | 200 mg/m$^2$ |
| Coupler solvent (*7) | 400 mg/m$^2$ |
| Gelatin | 700 mg/m$^2$ |
| Second Layer (Interlayer) | |
| Gelatin | 1,000 mg/m$^2$ |
| First Layer (Blue-Sensitive Layer) | |
| Silver chlorobromide emulsion (silver coverage) (silver bromide: 80 mol %; average diameter of silver chlorobromide particle: 0.8 μm) | 400 mg/m$^2$ |
| Yellow coupler (*8) | 500 mg/m$^2$ |
| Coupler solvent (*3) | 400 mg/m$^2$ |
| Gelatin | 700 mg/m$^2$ |

Support
Paper laminated with polyethylene on both sides.
*2 Coupler: 2-[α-(2,4-di-tert-pentylphenoxy)butane-amido]-4,6-dichloro-5-methylphenol
*3 Solvent: Trinonyl phosphate
*4 Ultraviolet absorbing agent: 2-(2-Hydroxy-3-sec-butyl-5-tert-butylphenol)benzotriazole
*5 Coupler: 1-(2,4,6-Trichlorophenyl)-3-(2-chloro-5-tetradecaneamido)anilino-2-pyrazolone-5-one
*6 Anti-fading agent: 2,5-Di-tert-hexylhydroquinone
*7 Solvent: Tricresyl phosphate
*8 Coupler: α-Pivaloyl-[α-(2,4-dioxy-5,5'-dimethyl-oxazolidine-3-yl)-2-chloro-5-α-(2,4-di-tert-pentyloxy)-butaneamido]acetoanilide The sensitizing dye of the red-sensitive layer of the sample and the compound represented by formula (II) were added prior to coating to prepare an emulsion (Comparative Examples). In addition, the preparation of the silver chlorobromide emulsion for the red-sensitive layer was carried out at a point that 85% of emulsion particles were formed, to prepare an emulsion (Examples of the present invention). To these emulsions were added the coupler of formula (I), which were then processed in the manner as shown in Table 4 to prepare Samples 21–26. A part of each sample was stored at room temperature (25° C.) for 2 days, and another part was stored high temperature and high humidity conditions (50° C., 80% RH) for 2 days. Then each sample was exposed to red light through a continuous wedge and then was developed by the following process.

| Processing Process | | |
|---|---|---|
| Color development | 33° C. | 3.5 minutes |
| Bleach-fixing | 33° C. | 1.5 minutes |
| Washing with water | 30° C. | 3 minutes |
| Drying | | |

Composition of the Color Developer

-continued

| | |
|---|---|
| Benzyl alcohol | 15 ml |
| Sodium sulfite | 5 g |
| Potassium bromide | 0.4 g |
| Hydroxylamine sulfate | 2 g |
| 4-(N—Ethyl-N—β-methanesulfonamido)-2-methylaniline sesquisulfate | 2 g |
| Sodium carbonate (monohydrate) | 30 g |
| Water to make | 1,000 ml (pH = 10.0) |

Composition of Bleach-Fixing Agent

| | |
|---|---|
| Iron (III) ethylenediaminetetraacetate | 45 g |
| Sodium sulfite | 10 g |
| 70 wt % Aqueous solution of ammonium thiosulfate | 160 ml |
| Tetrasodium ethylenediamine tetra-acetate | 5 g |
| Water to make | 1,000 ml (pH = 6.8) |

Each sample thus developed was measured for color density. The fog, sensitivity, and gamma of each sample are shown in Table 5.

TABLE 4

| Sample No. | Sensitizing Dye of Red-Sensitive Layer: Added Amount (mg/m$^2$) | | Adding Method | Cyan Coupler: Added Amount (mg/m$^2$) | | Compound II: Added Amount (mg/m$^2$) | | Adding Method |
|---|---|---|---|---|---|---|---|---|
| 21* | III-1 | 0.050 | Prior to coating | *2 of Table 3 | 400 | — | | — |
| 22* | " | " | Prior to coating | *2 of Table 3 | 400 | II-6 | 300 | Prior to coating |
| 23* | " | " | Prior to | II-1 | 530 | — | | — |
| 24* | " | " | Prior to coating | " | " | II-6 | 300 | Prior to coating |
| 25 | " | " | During particle formation | " | " | — | | — |
| 26 | " | " | During particle formation | " | " | II-6 | 300 | During particle formation |

(Note)
*Comparative examples

TABLE 5

| Sample No. | Storage at Room Temperature (2 days): Fog | Sensitivity | Gamma | Storage at 50° C., 80% RH (2 days): Fog | Sensitivity | Gamma |
|---|---|---|---|---|---|---|
| 21* | 0.14 | 1.15 | 2.78 | 0.15 | 0.88 | 2.56 |
| 22* | 0.12 | 1.25 | 2.86 | 0.14 | 1.00 | 2.63 |
| 23* | 0.13 | 1.06 | 2.86 | 0.14 | 0.78 | 2.56 |
| 24* | 0.12 | 1.14 | 2.94 | 0.14 | 0.92 | 2.56 |
| 25 | 0.13 | 1.27 | 2.87 | 0.14 | 1.20 | 2.78 |
| 26 | 0.10 | 1.35 | 2.94 | 0.11 | 1.32 | 2.87 |

(Note)
*Comparative examples

As apparent from Table 5, in Comparative Examples (Sample Nos. 21–24) in which a p-phenylenediamine-type coupler is used as the cyan coupler, desensitization is significant and, furthermore, the sensitizing dye is significantly removed, leading to a reduction in sensitivity and a reduction in contrast. On the other hand, in the samples of the present invention (Sample Nos. 25 and 26), even if the p-phenylenediamine-type coupler is used, desensitization does not occur, even when subjected to storage under high temperature and high humidity conditions, the desensitization and reduction in contrast can be almost prevented, and when the compound of formula (II) is used in combination, the development fog can be significantly inhibited.

In accordance with the present invention, diffusion sensitization as encountered by using the cyan couplers of formula (I) can be reduced, and furthermore a light-sensitive material in which development fog is inhibited can be obtained.

In particular, the problem of a reduction in sensitivity and a reduction in contrast which occurs when subjected to storage under high temperature and high humidity conditions can be solved by adding the sensitizing dye at the time of formation of the silver halide particles.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support and at least one silver halide emulsion layer on the support, wherein the emulsion layer contains a silver halide emulsion which has been spectrally sensitized by adding a spectral sensitizing dye prior to the completion of formation of silver halide particles, and at least one cyan coupler represented by formula (I)

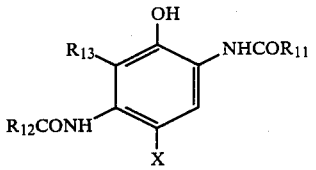

(I)

wherein $R_{11}$ and $R_{12}$ each represents an alkyl group, an aryl group, a heterocyclic group, an alkyloxy group, an aryloxy group, a heterocyclic oxy group, an alkylamino group, an arylamino group, or a heterocyclic amino group; $R_{13}$ represents a hydrogen atom, a halogen atom, an alkyl group, an aryl group, an alkoxyl group, an aryloxy group, an acyloxy group, or an acylamino group; X is a group capable of being released upon the oxidative coupling reaction with a developing agent; or $R_{12}$ and $R_{13}$ together form a 5- and 6-membered ring, and wherein the sensitizing dyes are dyes having the maximum value of spectral sensitivity at from 650 to 750 nm and are compounds represented by formula (III):

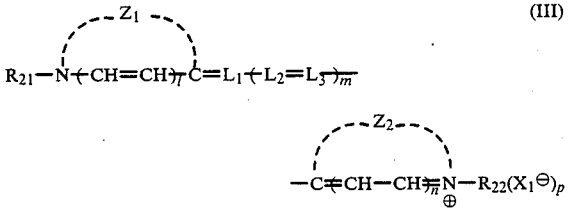

(III)

wherein in formula (III) $Z_1$ and $Z_2$ each represents an atomic group forming a 5- or 6-membered heterocyclic ring which may be substituted;

$L_1$, $L_2$ and $L_3$ each represents a methine group, which may be substituted;

$R_{21}$ and $R_{22}$ are each selected from the group consisting of an alkyl group, a carboxyalkyl group, a sulfoalkyl group, a fluorinated alkyl group, a hydroxyalkyl group, an alkoxyalkyl group, an aralkyl group, an aryloxyalkyl group, and an acylaminoalkyl group, each of which groups may be substituted;

$X_1^{\ominus}$ represents a counter ion;

l and n are each 0 or 1 and m is 0, 1, or 2, provided that $l+m+n=2$;

p is 0 or 1; and when $p=1$, the compounds of formula (III) form an intramolecular salt.

2. A silver halide color photographic material as in claim 1, wherein $R_{11}$ represents an alkyl group, an aryl group, an arylamino group, or a heterocyclic amino group; $R_{12}$ represents an alkyl group, an aryl group, an alkyloxy group, an alkylamino group, an arylamino group, or a heterocyclic amino group; $R_{13}$ represents a hydrogen atom, an alkyl group, an alkoxyl group, or an acylamino group; and X represents a hydrogen atom, a halogen atom, an alkoxyl group, an aryloxy group, an acyloxy group, a sulfonyloxy group, a sulfonamido group, an alkoxycarbonyl group, or a thio group.

3. A silver halide color photographic material as in claim 1, wherein $R_{11}$ represents a substituted or unsubstituted phenyl group, a heterocyclic amino group, or a substituted arylamino group; $R_{12}$ represents a substituted alkyl group or a substituted aryl group; $R_{13}$ represents a hydrogen atom or a ring resulting from the combination of $R_{12}$ and $R_{13}$; and X represents a hydrogen atom, a halogen atom, an alkoxyl group, or an aryloxy group.

4. A silver halide color photographic material as in claim 1, wherein the coupler represented by formula (I) contained in the emulsion is from $1\times10^{-3}$ to $7\times10^{-1}$ mol per mol of silver in the emulsion.

5. A silver halide color photographic material as in claim 1, wherein the spectrally sensitizing dye is M-band type or J-band type sensitizing dye.

6. A silver halide color photographic material as in claim 1, wherein a total amount of the spectrally sensitizing dye is added to a reaction solution concurrently with the start of formation of the silver halide particles or prior to the start of formation of the silver halide particles.

7. A silver halide color photographic material as in claim 1, wherein a total amount of the spectrally sensitizing dye is added during the formation of the silver halide particles.

8. A silver halide color photographic material as in claim 1, wherein a total amount of the spectrally sensitizing dye is added at a point when at least 85% of the total weight of the silver halide emulsion particles is formed.

9. A silver halide color photographic material as in claim 1, wherein the silver halide emulsion contains the compounds represented by formula (II) in combination with the spectrally sensitizing dyes

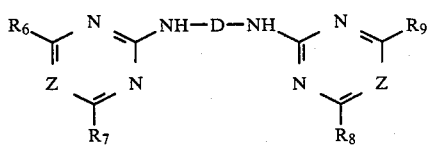

(II)

wherein Z represents —CH= or —N=; —D— represents a divalent aromatic residual group; $R_6$, $R_7$, $R_8$, and $R_9$ each represents a hydrogen atom, a hydroxyl group, an alkoxyl group, an aryloxy group, a halogen atom, a heterocyclic group, a mercapto group, an alkylthio group, an arylthio group, a heterocyclylthio group, an amino group, an alkylamino group, a cyclohexylamino group, an arylamino group, a heterocyclylamino group, an aryl group, and an aralkylamino group.

10. A silver halide color photographic material as in claim 9, wherein the compounds represented by formula (II) are used in a concentration of from 0.01 to 5 grams per mol of silver halide in the emulsion.

11. A silver halide color photographic material as in claim 9, wherein a weight ratio of the sensitizing dye to the compound represented by formula (II) is from 1/2 to 1/200.

12. A process for preparing a silver halide color photographic material comprising coating on a support and at least one silver halide emulsion layer, wherein the emulsion layer contains a silver halide emulsion which has been spectrally sensitized by adding a spectral sensitizing dye prior to the completion of formation of silver halide particles, and at least one cyan coupler represented by formula (I)

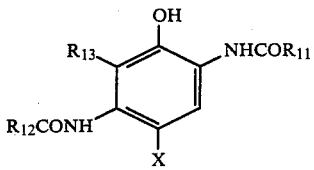

(I)

wherein $R_{11}$ and $R_{12}$ each represents an alkyl group, an aryl group, a heterocyclic group, an alkyloxy group, an aryloxy group, a heterocyclic oxy group, an alkylamino group, an arylamino group, or a heterocyclic amino group; $R_{13}$ represents a hydrogen atom, a halogen atom, an alkyl group, an aryl group, an alkoxyl group, an aryloxy group, an acyloxy group, or an acylamino group; X is a group capable of being released upon the oxidative coupling reaction with a developing agent; or $R_{12}$ and $R_{13}$ together form a 5- or 6-membered ring, and wherein the sensitizing dyes are dyes having the maximum value of spectral sensitivity at from 650 to 750 nm and are compounds represented by formula (III):

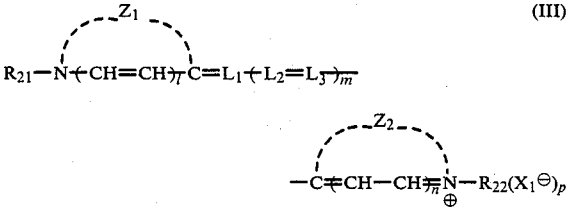

(III)

wherein in formula (III) $Z_1$ and $Z_2$ each represents an atomic group forming a 5- or 6-membered heterocyclic ring which may be substituted;

$L_1$, $L_2$ and $L_3$ each represents a methine group, which may be substituted;

$R_{21}$ and $R_{22}$ are each selected from the group consisting of an alkyl group, a carboxyalkyl group, a sulfoalkyl group, a fluorinated alkyl group, a hydroxyalkyl group, an alkoxyalkyl group, an aralkyl group, an aryloxyalkyl group, and an acylaminoalkyl group, each of which groups may be substituted;

$X_1^{\ominus}$ represents a counter ion;

l and n are each 0 or 1 and m is 0, 1, or 2, provided that $l+m+n=2$;

p is 0 or 1; and when $p=1$, the compounds of formula (III) form an intramolecular salt.

13. A process for preparing a silver halide color photographic material as in claim 12, wherein $R_{11}$ represents an alkyl group, an aryl group, an arylamino group, or a heterocyclic amino group; $R_{12}$ represents an alkyl group, an aryl group, an alkyloxy group, an alkylamino group, an arylamino group, or a heterocyclic amino group; $R_{13}$ represents a hydrogen atom, an alkyl group, an alkoxyl group, or an acylamino group; and X represents a hydrogen atom, a halogen atom, an alkoxyl group, an aryloxy group, an acyloxy group, a sulfonyloxy group, a sulfonamido group, an alkoxycarbonyl group, or a thio group.

14. A process for preparing a silver halide color photographic material as in claim 12, wherein $R_{11}$ represents a substituted or unsubstituted phenyl group, a heterocyclic amino group, or a substituted arylamino group; $R_{12}$ represents a substituted alkyl group or a substituted aryl group; $R_{13}$ represents a hydrogen atom or a ring resulting from the combination of $R_{12}$ and $R_{13}$; and X represents a hydrogen atom, a halogen atom, an alkoxyl group, or an aryloxy group.

15. A process for preparing a silver halide color photographic material as in claim 12, wherein the coupler represented by formula (I) contained in the emulsion is from $1\times10^{-3}$ to $7\times10^{-1}$ mol per mol of silver in the emulsion.

16. A process for preparing a silver halide color photographic material as in claim 12, wherein the spectrally sensitizing dye is M-band type or J-band type sensitizing dye.

17. A process for preparing a silver halide color photographic material as in claim 12, wherein a total amount of the spectrally sensitizing dye is added to a reaction solution concurrently with the start of formation of the silver halide particles or prior to the start of formation of the silver halide particles.

18. A process for preparing a silver halide color photographic material as in claim 12, wherein a total amount of the spectrally sensitizing dye is added during the formation of the silver halide particles.

19. A silver halide color photographic material comprising a support and at least one silver halide emulsion layer on the support, wherein the emulsion layer contains a silver halide emulsion which has been spectrally sensitized by adding a spectral sensitizing dye prior to the completion of formation of silver halide particles, and at least one cyan coupler represented by formula (I):

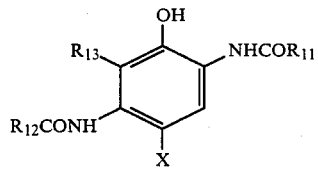

(I)

wherein $R_{11}$ and $R_{12}$ each represents an alkyl group, an aryl group, a heterocyclic group, an alkyloxy group, an aryloxy group, a heterocyclic oxy group, an alkylamino group, an arylamino group, or a heterocyclic amino group; $R_{13}$ represents a hydrogen atom, a halogen atom, an alkyl group, an aryl group, an alkoxyl group, an aryloxy group, an acyloxy group, or an acylamino group; X is a group capable of being released upon the oxidative coupling reaction with a developing agent; or $R_{12}$ and $R_{13}$ together form a 5- or 6-membered ring, and wherein the sensitizing dyes are dyes having the maximum value of spectral sensitivity at from 650 to 750 nm and are compounds represented by formula (III):

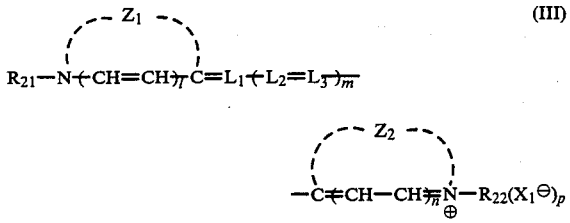

(III)

wherein in formula (III) $Z_1$ and $Z_2$ each represents an atomic group forming a 5- or 6-membered heterocyclic ring which may be substituted;

$L_1$, $L_2$ and $L_3$ each represents a methine group, which may be substituted;

$R_{21}$ and $R_{22}$ each represents a substituent selected from the group consisting of a methyl group, an ethyl group, a butyl group, a hexyl group, a carboxymethyl group, a 2-carboxyethyl group, and a 3-carboxypropyl group, a 2-sulfoethyl group, a 3-sulfopropyl group, a 3-sulfobutyl group, a 4-sulfobutyl group, a 2,2,2-trifluoroethyl group, a 2,2,3,3,-tetrafluoropropyl group, a 2-hydroxyethyl group, a 3-hydroxyethyl group, a 2-methoxyethyl group, a 2-ethoxyethyl group, a 3-methoxypropyl group, a benzyl group, a 2-phenylethyl group, a 2-(4-sulfophenyl)ethyl group, a 2-phenoxyethyl group, a methanesulfonylaminoethyl group and an acetylaminoethyl group $X_1^{\ominus}$ represents a counter ion; l and n are each 0 or 1 and m is 0, 1, or 2, provided that $l+m+n=2$;

p is 0 or 1; and when $p=1$, the compounds of formula (III) form an intramolecular salt.

* * * * *